US006040103A

United States Patent [19]

Ohno et al.

[11] Patent Number: 6,040,103

[45] Date of Patent: Mar. 21, 2000

[54] TONER FOR DEVELOPING ELECTROSTATIC IMAGE AND IMAGE FORMING METHOD

[75] Inventors: Manabu Ohno, Numazu; Takeshi Ohtake, Shizuoka-ken; Satoshi Matsunaga, Mishima; Tadashi Doujo, Numazu, all of Japan

[73] Assignee: Canon Kabushiki Kaisha, Tokyo, Japan

[21] Appl. No.: 08/921,565

[22] Filed: Sep. 2, 1997

[30] Foreign Application Priority Data

Sep. 2, 1996 [JP] Japan ..... 8-248482
Oct. 9, 1996 [JP] Japan ..... 8-268354

[51] Int. Cl.[7] ..... G03G 9/097; G03G 13/22

[52] U.S. Cl. ..... 430/110; 430/111; 430/124

[58] Field of Search ..... 430/110, 111, 430/124

[56] References Cited

U.S. PATENT DOCUMENTS

| | | | |
|---|---|---|---|
| 2,297,691 | 10/1942 | Carlson | 430/31 |
| 3,666,363 | 5/1972 | Tanaka et al. | 430/55 |
| 4,071,361 | 1/1978 | Marushima | 430/55 |
| 4,578,338 | 3/1986 | Gruber et al. | 430/120 |
| 4,917,982 | 4/1990 | Tomono et al. | 430/99 |
| 4,990,424 | 2/1991 | Van Dusen et al. | 430/106.6 |
| 5,407,773 | 4/1995 | Furuta et al. | 430/100 |
| 5,605,778 | 2/1997 | Onuma et al. | 430/110 |

FOREIGN PATENT DOCUMENTS

| | | |
|---|---|---|
| 0-530020 | 3/1993 | European Pat. Off. . |
| 0-531990 | 3/1993 | European Pat. Off. . |
| 0-718703 | 6/1996 | European Pat. Off. . |
| 52-3304 | 1/1977 | Japan . |
| 52-3305 | 1/1977 | Japan . |
| 57-52574 | 11/1982 | Japan . |
| 60-217366 | 10/1985 | Japan . |
| 60-252360 | 12/1985 | Japan . |
| 60-252361 | 12/1985 | Japan . |
| 61-273554 | 12/1985 | Japan . |
| 61-94062 | 5/1986 | Japan . |
| 61-138259 | 6/1986 | Japan . |
| 62-14166 | 1/1987 | Japan . |
| 1-109359 | 4/1989 | Japan . |
| 1-128071 | 5/1989 | Japan . |
| 2-79860 | 3/1990 | Japan . |
| 3-50559 | 3/1991 | Japan . |
| 4-353866 | 12/1992 | Japan . |
| 0-587901 | 3/1994 | Japan . |
| 6-59504 | 3/1994 | Japan . |

OTHER PUBLICATIONS

G.W. Castellan, "Physical Chemistry. Third Ed.", Publ. by Addison–Wesley Publ. Co., 1983, pp. 604–609.

Polymer Analysis Handbook, pp. 1667, 1668, 1670, (1995), publ. by Japan Soc. Anal. Chem. (Res. Comm. Polym. Anal.) ISBN 4–314–10110–5.

*Primary Examiner*—Roland Martin

*Attorney, Agent, or Firm*—Fitzpatrick, Cella, Harper & Scinto

[57] ABSTRACT

A toner for developing an electrostatic image is composed of toner particles each containing at least a binder resin, a colorant, and a wax. The wax satisfies conditions of:

(a) showing a maximum heat-absorption peak in a region of 50–130° C. on temperature increase on a DSC (differential scanning calorimeter) curve, and (b) giving a $^{13}$C-NMR (nuclear magnetic resonance) spectrum showing a total peak area S in a range of 0–50 ppm, a total peak area S1 in a range of 36–42 ppm and a total peak area S2 in a range of 10–17 ppm satisfying:

$$1.0 \leqq (S1/S) \times 100 \leqq 10,\ 1.5 \leqq (S2/S) \times 100 \leqq 15, \text{ and } S1 < S2.$$

The wax satisfying the above-conditions has an appropriately branched long-chain structure and provides the toner with a good balance of good low-temperature fixability and anti-hot-temperature offset characteristic.

62 Claims, 10 Drawing Sheets

TONER FOR DEVELOPING ELECTROSTATIC IMAGE AND IMAGE FORMING METHOD

FIELD OF THE INVENTION AND RELATED ART

The present invention relates to a toner for developing electrostatic images used in image forming methods, such as electrophotography, electrostatic recording or electrostatic printing, and an image forming method using the toner.

Hitherto, a large number of electrophoto-graphic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image.

As for the step of fixing the toner image onto a sheet material such as paper which is the final step in the above process, various methods and apparatus have been developed, of which the most popular one is a heating and pressing fixation system using hot rollers, or a fixed heat generating heater for fixation via a heat-resistant film.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

In the fixing step, however, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be low in case of a slow fixing speed and set to be high in case of a fast fixing speed. This is because a constant heat quantity is supplied to the toner image for fixation thereof regardless of a difference in fixing speed.

The toner on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause an offset phenomenon in case of a high heating roller temperature, while a low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, the occurrence of a trace in the fixed image of a separating member for separating the fixation sheet from the fixing roller, and inferior fixed images, such as resolution failure of line images and toner scattering, due to a high pressure.

In a high-speed fixing system, a toner having a lower melt viscosity is generally used than in the case of low speed fixation, so as to lower the heating roller temperature and fixing pressure, thereby effecting the fixation while obviating the high-temperature offset and winding offset. However, in the case of using such a toner having a low melt viscosity in low speed fixation, an offset phenomenon is liable to be caused because of the low viscosity.

Accordingly, there has been desired a toner which shows a wide fixable temperature range and an excellent anti-offset characteristic and is applicable from a low speed apparatus to a high speed apparatus.

The use of a smaller particle size toner can increase the resolution and clearness of an image, but a smaller particle size toner is liable to impair the fixability of a halftone image. This is particularly noticeable in high-speed fixation. This is because the toner coverage in a halftone part is little and a portion of toner transferred to a concavity of a fixation sheet receives only a small quantity of heat and the pressure applied thereto is also suppressed because of the convexity of the fixation sheet. A portion of toner transferred onto the convexity of the fixation sheet in a halftone part receives a much larger shearing force per toner particle because of a small toner layer thickness compared with that in a solid image part, thus being liable to cause offset or result in copy images of a lower image quality.

Japanese Laid-Open Patent Application (JP-A) 1-128071 has disclosed an electrophotographic developer toner comprising a polyester resin as a binder resin and having a specific storage modulus, but the toner has left some room for improvement of fixability and anti-offset characteristic.

JP-A 4-353866 has disclosed an electrophotographic toner having specific rheological proportions including a storage modulus falling initiation temperature in the range of 100–110° C., a specific stage modulus at 150° C., and a loss modulus peak temperature of at least 125° C. The toner, however, has too low storage modulus and loss modulus and also too high a loss modulus peak temperature, so that the low-temperature fixability has not been improved and the toner shows a low heat resistance.

JP-A 6-59504 has disclosed an electrophotographic toner comprising a polyester resin of a specific structure as a binder resin, having a specific storage modulus at 70–120° C. and having a specific loss modulus at 130–180° C. However, as the storage modulus at 70–120° C. is high and the loss modulus at 130–180° C. is low, the toner when constituted as a small-particle size magnetic toner shows a rather low fixability at low temperatures and has left a room for improvement regarding the anti-offset characteristic.

JP-A 7-349002 has disclosed a toner for developing electrostatic images having a specific storage modulus at 100° C. and a specific value of ratio between storage moduli at 60° C. and 70° C.

It has been also known to incorporate a wax as a release agent in a toner, e.g., as disclosed in Japanese Patent Publication (JP-B) 52-3304, JP-B 52-3305 and JP-A 57-52574.

Wax-inclusion techniques are also disclosed in, e.g., JP-A 3-50559, JP-A 2-79860, JP-A 1-109359, JP-A 62-14166, JP-A 61-273554, JP-A 61-94062, JP-A 61-138259, JP-A 60-252361, JP-A 60-252360, and JP-A 60-217366.

Wax has been used to provide an improved anti-offset characteristic and an improved low-temperature fixability. The use of only a low-melting point wax is liable to provide a more or less inferior anti-blocking property and a lowering in toner flowability or an inferior developing performance when the toner is exposed to a temperature increase in a copying machine, etc., to cause the migration of the wax to the toner surface. On the other hand, when a high-melting point wax alone is used, it is impossible to expect an improvement in low-temperature fixability.

SUMMARY OF THE INVENTION

A generic object of the present invention is to provide a toner for developing electrostatic images having solved the above-mentioned problems.

A more specific object of the present invention is to provide a toner for developing electrostatic images exhibiting a good low-temperature fixability even when the toner is formed in a smaller particle size and the content of a colorant (particularly a magnetic material) is increased correspondingly.

Another object of the present invention is to provide a toner for developing electrostatic images having a good low-temperature fixability without lowering the flowability or the anti-blocking property of the toner.

Another object of the present invention is to provide a toner for developing electrostatic images having good low-temperature fixability and good anti-high-temperature offset characteristic in combination.

Another object of the present invention is to provide a toner for developing electrostatic images which is well adapted to a wide range of copying machines from a low-speed machine to a high-speed machine, has good low-temperature fixability and has excellent anti-high-temperature offset characteristic, anti-blocking property and flowability.

Another object of the present invention is to provide a toner for developing electrostatic images showing excellent fixability even at a halftone portion and capable of providing fixed images of good image quality.

Another object of the present invention is to provide a toner for developing electrostatic images capable of providing high-density fixed images free of fog in a wide range of copying machines including a low-speed machine to a high-speed machine.

A further object of the present invention is to provide a toner for developing electrostatic images exhibiting excellent performance for developing digital latent images.

A still further object of the present invention is to provide an image forming method using a toner as described above.

According to the present invention, there is provided a toner for developing an electrostatic image, comprising: toner particles each containing at least a binder resin, a colorant, and a wax;

wherein the wax satisfies conditions of:

(a) showing a maximum heat-absorption peak in a region of 50–130° C. on temperature increase on a DSC (differential scanning calorimeter) curve, and (b) giving a $^{13}$C-NMR (nuclear magnetic resonance) spectrum showing a total peak area S in a range of 0–50 ppm, a total peak area S1 in a range of 36–42 ppm and a total peak area S2 in a range of 10–17 ppm satisfying:

$$1.0 \leqq (S1/S) \times 100 \leqq 10,\ 1.5 \leqq (S2/S) \times 100 \leqq 15, \text{ and } S1 < S2.$$

According to another aspect of the present invention, there is provided an image forming method, comprising:

a charging step of charging an electrostatic image-bearing member, a latent image forming step of forming an electrostatic image on the electrostatic image-bearing member, a developing step of developing the electrostatic image with the above-mentioned toner to form a toner image on the electrostatic image-bearing member, a transfer step of transferring the toner image on the electrostatic image-bearing member onto a transfer receiving material via or without via an intermediate transfer member, and a fixing step of fixing the toner image onto the transfer-receiving material under application of heat.

These and other objects, features and advantages of the present invention will become more apparent upon a consideration of the following description of the preferred embodiments of the present invention taken in conjunction with the accompanying drawings.

DETAILED DESCRIPTION OF THE INVENTION

According to our study, in order to provide a small-particle size toner with good low-temperature fixability and anti-high-temperature offset characteristic in combination, it has been found critical to incorporate a specific wax in the toner.

Ordinary waxes heretofore added to a toner for improving the fixability are those having a narrow molecular weight distribution, a linear molecular structure with little branching and a sharp-melting characteristic as represented by little temperature difference between a melt initiation temperature and a melt completion temperature on melting under heating. When such a wax is used, the low-temperature fixability of the toner is actually improved, but the anti-high-temperature offset characteristic is liable to be lowered. This is because such a wax once melted assumes a melt viscosities which is extremely lowered on temperature increase to excessively lower the melt viscosity of the toner. This results in a lower anti-high-temperature offset characteristic.

According to our study, it has been found that a toner containing a wax having a specific branched long-chain structure satisfies good low-temperature fixability and anti-hot-offset characteristic in combination.

A characteristic feature of the wax used in the present invention is that it provides a DSC curve obtained by using a DSC (differential scanning calorimeter) showing a maximum heat-absorption peak in a temperature region of 40–130° C. in the course of temperature increase. By having a maximum heat-absorption peak in the above-mentioned temperature range, the wax exhibits an effective release effect while contributing to low-temperature fixation. If the maximum heat-absorption peak appears at a temperature below 40° C., the wax shows only weak self-cohesion to result in a lowering in anti-high-temperature offset characteristic and an excessively high gloss of fixed image. On the other hand, if the maximum heat-absorption peak temperature exceeds 130° C., the toner is caused to show a high fixation temperature and it becomes difficult to provide a fixed image surface with an appropriate degree of smoothness. Particularly, in the case of a color toner, the color mixability can be undesirably lowered.

In case where the wax exhibits a melt viscosity $\eta_1$ at a temperature 5° C. higher than the maximum heat-absorption peak temperature and a melt viscosity $\eta_2$ at a temperature 15° C. higher than the maximum heat-absorption peak temperature providing a ratio $\eta_1/\eta_2$ of at most 10, preferably 0.1–7, further preferably 0.2–5, the resultant toner may be provided with further improved low-temperature fixability and anti-high-temperature offset characteristic.

Figure 1:
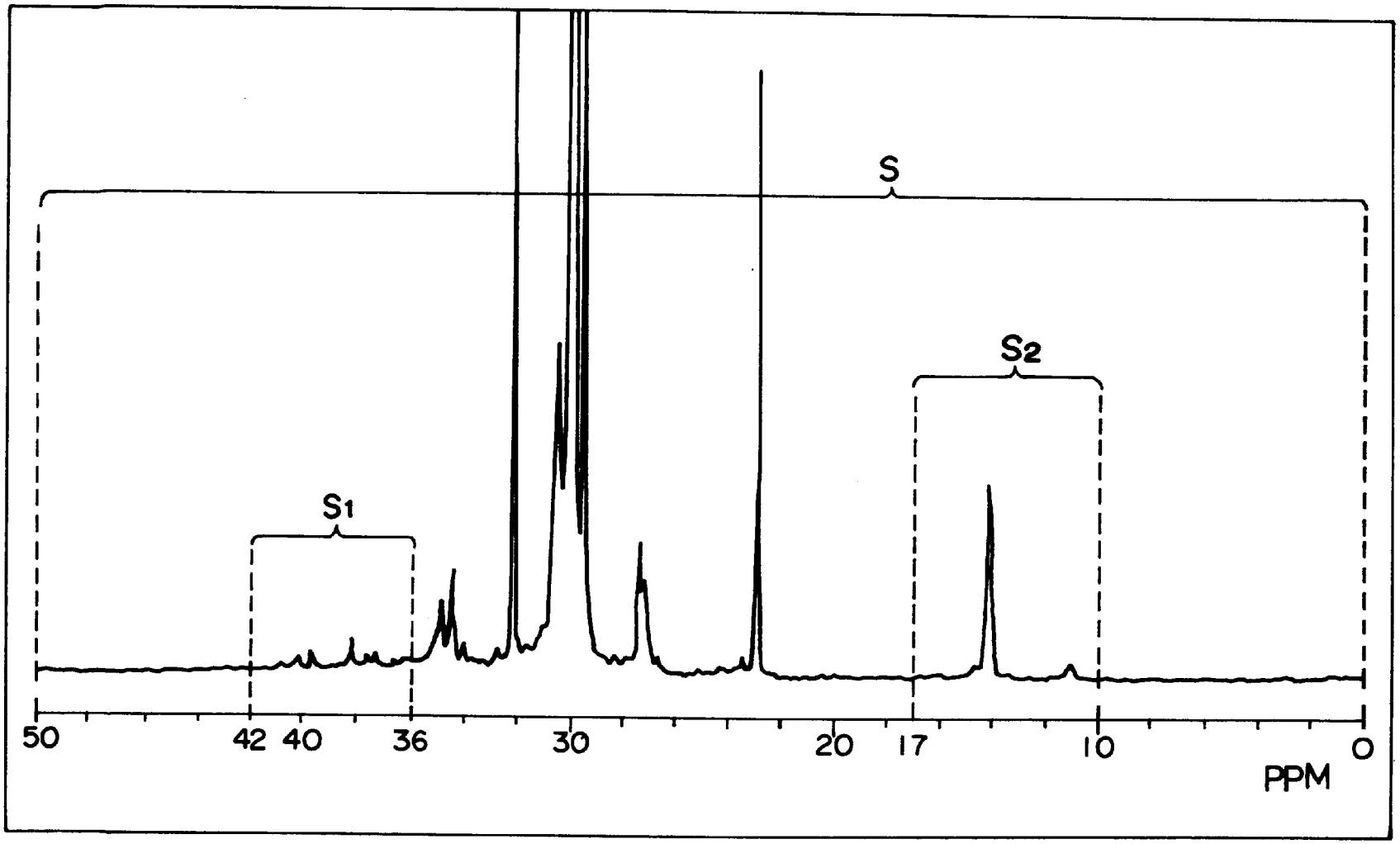
FIG. 1 shows a $^{13}$C-NMR spectrum of Branched wax No. 1 used in Example 1.

FIG. 1 shows a $^{13}$C-NMR (nuclear magnetic resonance) spectrum of a wax suitably used in the present invention (more specifically. Branched wax No. 1 used in Example 1 appearing hereinafter). With reference to FIG. 1, the wax suitably used in the present invention is one giving a $^{13}$C-NMR (nuclear magnetic resonance) spectrum showing a total peak area S in a range of 0–50 ppm, a total peak area S1 in a range of 36–42 ppm and a total peak area S2 in a range of 10–17 ppm satisfying the following formulae (1)–(3):

$$1.0 \leqq (S1/S)\times 100 \leqq 10 \quad (1)$$

$$1.5 \leqq (S2/S)\times 100 \leqq 15 \quad (2),$$

and $$S1 < S2 \quad (3).$$

S1 is distributable to tertiary and quaternary carbon atoms in the wax molecules, so that S1 represents the presence of a branched structure and not that the wax is composed of a simple linear polymethylene. S2 is attributable to primary carbon atoms of methyl groups at the terminals of main chains and branched chains of wax molecules.

The wax used in the present invention may preferably have a [(S1/S)×100] value of 1.5–8.0 and a [(S2/S)×100] value of 2.0–13.0, more preferably a [(S1/S)×100] value of 2.0–6.0 and a [(S2/S)×100] value of 3.0–10.0.

A wax having a [(S1/S)×100] value below 1.0 and a value [(S2/S)×100] value 1.5 is one having a long chain of few branches and causing little entanglement of wax molecules in the molten state thereof to result in a lowering in melt index, thus making it difficult to realize an improved anti-high-temperature offset characteristic which is an object of the present invention If the [(S1/S)×100] value exceeds 10.0 and the [(S2/S)×100] value exceeds 15.0, the wax has long chains with excessively many branches to cause an excessively high melt viscosity, thus making it difficult to realize an improved low-temperature fixability which is another object of the present invention.

If the wax has an adequately branched long-chain structure, a toner containing the wax may be provided with improved low-temperature fixability and anti-high-temperature offset characteristic. Further, as an adequate degree of shearing force can be applied to a composition for providing a toner during a melt-kneading step for the toner production, the dispersion of the respective toner ingredients can be dispersed to provide an improved developing performance. On the other hand, in the case of toner production by direct polymerization, the wax is melted under heating in a monomer condition to provide the monomer composition with an increased solution viscosity which is desirable for uniform dispersion of the respective toner additives, such as a colorant, and suitable for particle formation in a suspension form to provide a toner with an improved particle size distribution and improved toner performances similarly as in the case of toner production according to the melt-kneading process.

The wax used in the present invention having a branched long-chain structure may preferably have a weight-average molecular weight (Mw) of 600–50,000, more preferably 800–40,000, further preferably 1,000 –30,000. It is further preferred that the wax has a number-average molecular weight (Mn) of 400–4,000, more preferably 450–3,500, and the wax has an Mw/Mn ratio of 3.5–30, more preferably 4–25.

The wax having a branched long-chain structure used in the present invention may for example be a wax comprising hydrocarbon compounds having a branched long-chain structure as represented by the following formula:

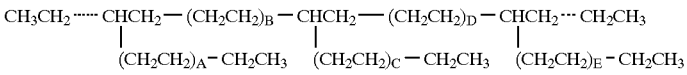

wherein A, C and E respectively denote a positive number of at least 1, and B and D denote a positive number. The wax may be prepared by copolymerizing an α-monoolefinic hydrocarbon as represented by

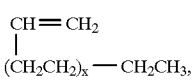

herein x is an integer of at least 1, with ethylene. It is preferred that the α-monoolefinic hydrocarbon is a mixture of species having different values of x, and an average of x may preferably be in the range of 5–30 so as to provide a toner with further improved low-temperature fixability and anti-high-temperature offset characteristic.

In case where the toner according o the present invention is one produced through a sequence of melt-kneading and pulverization, the wax may preferably be contained in 1–20 wt. parts, more preferably 2–17 wt. parts, further preferably 3 –15 wt. parts, per 100 wt. parts of the binder resin. By containing the wax in such an amount, the toner may be provided with improved low-temperature fixability, anti-blocking property and anti-offset characteristic, while suppressing the occurrence of isolated wax particles from the toner particles.

In case where the toner according to the present invention is produced as a polymerization toner, the wax may preferably be contained in 5–20 wt. parts per 100 wt. parts of the resin component constituting the toner particles.

The wax can contain an antioxidant within an extent of not adversely affecting the chargeability of the resultant toner.

The wax having a branched long-chain structure can be used in combination with a wax component having a relatively low melting point or a wax component having a relatively high melting point.

The wax having a branched long-chain structure having a maximum heat-absorption peak temperature $W_1$° C. may preferably be combined with another wax having a maximum heat-absorption peak temperature of $W_2$° C. satisfying a relationship of:

$$80(^\circ\ \mathrm{C.}) \leqq (W_1+W_2)/2 \leqq 110(^\circ\ \mathrm{C.}).$$

The wax having a branched long-chain structure and such another wax may be blended with a weight ratio of 1/4–9/1, preferably 1/3–8/1, more preferably 1/2–7/1. By satisfying the ratio, the resultant toner may be provided with further improved low-temperature fixability and anti-hot-offset characteristic without impairing the excellent property of the wax having a branched long-chain structure.

The toner according to the present invention can contain one or more species of another third wax component within an extent of not hindering the effects of the present invention so as to effect a delicate adjustment of the low-temperature fixability, anti-blocking property and anti-offset characteristic. Such a third wax component should be suppressed to at most 20 wt. % of the total waxes and may preferably have a maximum heat-absorption peak temperature in a range of 60–140° C.

Examples of preferred combination of waxes may be enumerated as follows.

(1) Combination of a low-melting point branched long-chain wax and a high-melting point branched long-chain wax:

The low-melting point branched long-chain wax may have a maximum heat-absorption peak temperature of 60–80° C., a weight-average molecular weight (Mw) of 700–20,000, and an Mw/Mn (number-average molecular weight) ratio of 4–15.

The high-melting point branched long-chain wax may have a maximum heat-absorption peak temperature of 90–120° C., Mw=1,500–40,000 and Mw/Mn=5–20.

(2) Combination of a low-melting point branched long-chain wax and a high-melting point wax:

The low-melting point branched long-chain wax may be identical to the one indicated above.

The high-melting pint wax may preferably comprise polypropylene wax, ethylene-propylene copolymer wax, or a wax comprising long-chain alkyl groups with little branching and containing at least 50 wt. % of alkyl groups having a terminal or intra-molecular substituent (such as hydroxyl and/or carboxyl). The high-melting point wax may have a maximum heat-absorption peak temperature of 85–150° C., Mw=800–15,000 and Mw/Mn=1.5–3.

(3) Combination of a low-melting point wax and a high-melting point branched long-chain wax:

The low-melting point wax may be a wax comprising long-chain alkyl groups with little branching. The wax can have a terminal or intra-molecular substituent other than hydrogen, such as hydroxyl and/or carboxyl. The low-melting point wax may preferably contain at least 40 wt. % of such wax components comprising alkyl groups having such a substituent. The low-melting point wax may preferably have a maximum heat-absorption peak temperature of 70 –90° C., Mw=400–700 and Mw/Mn=1.5–2.5.

The low-melting point wax may include hydrocarbon waxes having a long-chain alkyl group with little branching. Specific examples thereof may include: a low-molecular weight alkylene polymer wax obtained through polymerization of an alkylene by radical polymerization under a high pressure or in the presence of a Ziegler catalyst under a low pressure; an alkylene polymer wax obtained by thermal decomposition of an alkylene polymer of a high molecular weight; and a synthetic hydrocarbon wax obtained by subjecting a mixture gas containing carbon monoxide and hydrogen to the Arge process to form a hydrocarbon mixture and distilling the hydrocarbon mixture to recover a residue, or hydrogenating the residue. Fractionation of wax may preferably be performed by the press sweating method, the solvent method, vacuum distillation or fractionating crystallization. As the source of the hydrocarbon wax, it is preferred to use hydrocarbons having up to several hundred carbon atoms as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon.

The above-mentioned long-chain alkyl groups can be substituted at a portion of their terminals with a hydroxyl group or another functional group derived from a hydroxyl group (such as a carboxyl group, an ester group, an ethoxy group, or a sulfonyl group). A long-chain alkyl alcohol may for example be obtained through a process including polymerizing ethylene in the presence of a Ziegler catalyst, oxidizing the polymerizate to form an alkoxide of the catalyst metal and ethylene and then hydrolizing the alkoxide.

The high-melting point wax may for example comprise a hydrocarbon wax having a long-chain alkyl group with little branching and ethylene-propylene copolymer. Specific examples thereof may include: a low-molecular weight alkylene polymer wax obtained through polymerization of an alkylene by radical polymerization under a high pressure or in the presence of a Ziegler catalyst under a low pressure; an alkylene polymer wax obtained by thermal decomposition of an alkylene polymer of a high molecular weight; and a synthetic hydrocarbon wax obtained by subjecting a mixture gas containing carbon monoxide and hydrogen to the Arge process to form a hydrocarbon mixture and distilling the hydrocarbon mixture to recover a residue, or hydrogenating the residue.

The above-mentioned long-chain alkyl groups can be substituted at a portion of their terminals with a hydroxyl group or another functional group derived from a hydroxyl group (such as a carboxyl group, an ester group, an ethoxy group, or a sulfonyl group), or can form a copolymer with another monomer, such as styrene, a (meth)acrylic acid or an ester thereof or maleic anhydride.

The toner according to the present invention may preferably exhibit viscoelasticity characteristics such that it has a first temperature between 50–70° C. where the storage modulus (G') and the loss modulus (G") are identical to each other, has a second temperature between 65–80° C. where a ratio G'/G" assumes a maximum, and provides a ratio (Gc/G'p) of a storage modulus Gc at the first temperature to a loss modulus G'p at the second temperature of at least 50, preferably 55–150, further preferably 60–120.

In case here the ratio Gc/G'p is below 50, the toner may exhibit excellent anti-hot-offset characteristic but is liable to show a lower fixability or a lower anti-blocking characteristic. If the ratio (Gc/G'p) exceeds 150, the toner may exhibit excellent fixability but can possibly exhibit a lower anti-hot-offset characteristic.

The toner according to the present invention includes a binder resin which may preferably comprise a polyester resin, a vinyl resin or a mixture of these.

The polyester resin preferably used in the present invention may have a composition as described below.

The polyester resin used in the present invention may preferably comprise 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

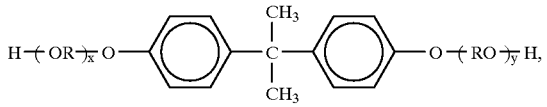

wherein R denotes an ethylene or propylene group, x and y are independently 0 or a positive integer with the proviso that the average of x+y is in the range of 0–10; diols represented by the following formula (B):

(B)

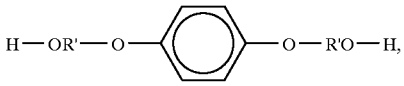

wherein $R^1$ denotes $—CH_2CH_2—$,

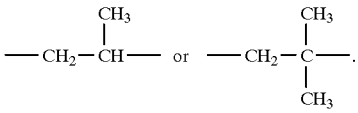

Examples of the dibasic acid constituting at least 50 mol. % of total acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

Examples of polyhydric alcohols may include: glycerin, pentaerythritol, sorbitol, sorbitan, and oxyalkylene ethers of novolak-type phenolic resin. Examples of polybasic carboxylic acids having three or more functional groups may include: trimellitic acid, pyromellitic acid, benzophenonetetracarboxylic acid, and their anhydride.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride. Preferred examples of crosslinking components may include trimellitic anhydride, benzophenonetetracarboxylic acid, pentaerythritol, and oxyalkylene ether of novolak-type phenolic resin.

The polyester resin may preferably have a glass transition temperature of 40–90° C., particularly 45–85° C., a number-average molecular weight (Mn) of 1,000–50,000, more preferably 1,500–20,000, particularly 2,500–10,000, and a weight-average molecular weight (Mw) of $3\times10^3$–$3\times10^6$, more preferably $1\times10^4$–$2.5\times10^6$, further preferably $4.0\times10^4$–$2.0\times10^6$.

Examples of a vinyl monomer to be used for providing the vinyl resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of an acid value-providing or carboxy group-containing monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, monomethyl alkenylsuccinate, monomethyl fumarate, and monomethyl mesaconate; unsaturated dibasic acid esters, such as dimethyl maleate and dimethyl fumarate; αβ-unsaturated acids, such as acrylic acid, methacrylic acid, crotonic acid, and cinnamic acid; α, β-unsaturated acid anhydrides, such as crotonic anhydride, and cinnamic anhydride; anhydrides between such an α, β-unsaturated acid and a lower aliphatic acid; alkenylmalonic acid, alkenylglutaric acid, alkenyladipic acid, and anhydrides and monoesters of these acids.

It is also possible to use a hydroxyl group-containing monomer: inclusive of acrylic or methacrylic acid esters, such as 2-hydroxyethyl acrylate, and 2-hydroxyethyl methacrylate; 4-(1-hydroxy-1-methylbutyl)styrene, and 4-(1-hydroxy-1-methylhexyl)styrene.

The vinyl resin may have a glass transition point of 45–80° C., preferably 55–70° C., a number-average molecular weight (Mn) of $2.5\times10^3$–$5\times10^4$, preferably $3\times10^3$–$2\times10^4$, and a weight-average molecular weight (Mw) of $1\times10^4$–$1.5\times10^6$, preferably $2.5\times10^4$–$1.25\times10^6$.

It is preferred that the toner has a molecular weight distribution measured with respect to a filtrate of a solution thereof in a solvent, such as tetrahydrofuran (THF), by gel permeation chromatography such that it provides peaks at least in a lower molecular weight region of $2\times10^3$–$4\times10^4$, preferably $3\times10^3$–$3\times10^4$, more preferably $3.5\times10^3$–$2\times10^4$, and in a higher molecular weight region of $5\times10^4$–$1.2\times10^6$, preferably $8\times10^4$–$1.1\times10^6$, more preferably $1.0\times10^5 1.0\times10^6$.

As another preferred mode, the filtrate of the toner solution may preferably provide a molecular weight distribution such that a lower molecular weight region of at most $4.5\times10^4$ and a region of a larger molecular weight provide an areal ratio of 1:9–9.5:0.5, preferably 2:8–9:1, further preferably 3:7 –8.5:1.5.

In order to have the wax exhibit its excellent performances, it is important to select an appropriate method of blending the binder resin and the wax.

As an ordinary method, a finely particulated form of the wax may be blended with other ingredients, such as a binder resin, a colorant (or magnetic material), etc., under stirring by means of a blender, such as a Henschel mixer, and then the blend is melt-kneaded. In this instance, it is possible to melt-mix the wax having a branched long-chain structure with the second wax component in advance. As another wax blending method, the binder resin may be dissolved in an organic solvent, and then the wax is added thereto, following by evaporation of the solvent to recover the binder resin-wax mixture. Alternatively, without using an organic solvent, the wax can be added to a binder resin melted under heating. In case of adding the wax into the binder resin according to these methods, it is possible to use a wax blend prepared in advance by melt-kneading the branched long-chain wax and the second wax component. The wax can also be added in a process of synthesizing the binder resin. Also in this instance, the wax can be a blend prepared in advance by melt-mixing for adjusting the components. As another method, the branched long-chain wax alone may be added to the binder resin. More specifically, this may be performed by melting the binder resin and adding thereto the wax component; by dissolving the binder resin in an organic solvent under heating, adding thereto the wax component and evaporating off the solvent to leave the binder-wax blend; or by adding the wax component in the process of synthesizing the binder resin.

When the toner according to the present invention is constituted as a magnetic toner, the magnetic toner may contain a magnetic material, examples of which may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_9$), nickel iron oxide ($NiFe_2O_4$), neodymium iron oxide ($NdFe_2O_3$), barium iron oxide ($BaFe_{12}O_9$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or γ-diiron trioxide.

The magnetic material may have an average particle size (Dav.) of 0.1–2 μm, preferably 0.1–0.5 μm. The magnetic material may preferably show magnetic properties when measured by application of 10 kilo-Oersted, inclusive of: a coercive force (Hc) of 20–150 Oersted, a saturation magnetization (as) of 50–200 emu/g, particularly 50–100 emu/g, and a residual magnetization (or) of 2–20 emu/g.

The magnetic material may be contained in the toner in a proportion of 10–200 wt. parts, preferably 20–150 wt. parts, per 100 wt. parts of the binder resin.

The toner according to the present invention may optionally contain a non-magnetic colorant, examples of which may include: carbon black, titanium white, and other pigments and/or dyes. For example, the toner according to the present invention, when used as a color toner, may contain a dye, examples of which may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6. Examples of the pigment may include: Chrome Yellow, Cadmium Yellow, Mineral Fast Yellow, Navel Yellow, Naphthol Yellow S, Hansa Yellow G, Permanent Yellow NCG, Tartrazine Lake, Orange Chrome Yellow, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B; Manganese Violet, Fast Violet B, Methyl Violet Lake, Ultramarine, Cobalt BLue, Alkali Blue Lake, Victoria Blue Lake, Phthalocyanine Blue, Fast Sky Blue, Indanthrene Blue BC, Chrome Green, chromium oxide, Pigment Green B, Malachite Green Lake, and Final Yellow Green G.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments represented by the following formula and having a phthalocyanine skeleton to which 1–5 phthalimidomethyl groups are added:

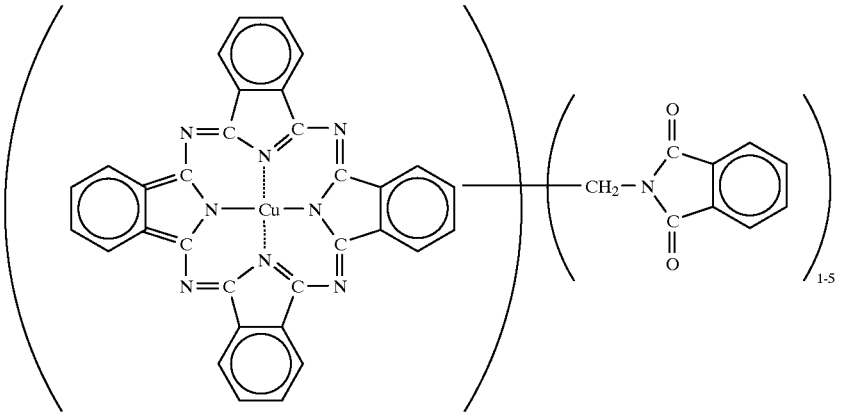

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 0.1–60 wt. parts, preferably 0.5–50 wt. parts, per 100 wt. parts of the binder resin.

The toner according to the present invention can further contain a charge control agent. Examples of the charge control agent may include organometal complexes and chelate compounds, inclusive of mono-azo metal complexes, aromatic hydroxycarboxylic acid metal complexes and aromatic dicarboxylic acid metal complexes. Other examples may include: aromatic hydroxycarboxylic acids, aromatic mono- and poly-carboxylic acids, metal salts, anhydrides and esters of these acids, and phenol derivatives of bisphenols.

When the toner according to the present invention is used in an image forming method using an intermediate transfer member may preferably have a shape factor SF-1 of 100–160, a shape factor SF-2 of 100–140 and a ratio (SF-2/SF-1) of at most 1.0 based on analysis by an image analyzer.

The shape factors SF-1 and SF-2 referred to herein are based on values measured in the following manner. Sample particles are observed through a field-emission scanning electron microscope ("FE-SEM S-800", available from Hitachi Seisakusho K. K.) at a magnification of 500, and 100 images of toner particles having a particle size (diameter) of at least 2 $\mu$m are sampled at random. The image data are inputted into an image analyzer ("Luzex 3", available from Nireco K. K.) to obtain averages of shape factors SF-1 and SF-2 based on the following equations:

$$SF\text{-}1=[(MXLNG)^2/AREA]\times(\pi/4)\times100,$$

$$SF\text{-}2=[(PERI)^2/AREA]\times(1/4\pi)\times100,]$$

wherein MXLNG denotes the maximum length of a sample particle, PERI denotes the perimeter of a sample particle, and AREA denotes the projection area of the sample particle.

The shape factor SF-1 represents the roundness of toner particles, and the shape factor SF-2 represents the roughness of toner particles.

Hitherto, in case where toner particles having small shape factors SF-1 and SF-2 are used, a cleaning failure is liable to occur and an external additive is liable to be embedded at the toner particle surfaces, thus resulting in inferior image quality. In the present invention, however, it is possible to obviate these difficulties by controlling the branch density and branch state of the wax component to provide the toner particles with an adequate strength. On the other hand, if SF-1 exceeds 160 in case where an intermediate transfer member is included in the image forming apparatus, a lowering in transfer efficiency is recognized both during the transfer of toner images from the electrostatic image-bearing member to the intermediate transfer member and the transfer from the intermediate member to the transfer-receiving material.

In order to provide a high toner image transfer efficiency, the toner particles may preferably have a shape factor SF-2 of 100–140, and a ratio (SF-2/SF-1) of at most 1.0. In case where SF-2 exceeds 140 and the ratio SF-2/SF-1 exceeds 1.0, the toner particle surface is not smooth but is provided with many unevennesses, so that the transfer efficiency is liable to be lowered during the transfer from the electrostatic image-bearing member via the intermediate transfer member to the transfer-receiving material.

The above-mentioned tendency regarding the toner image transfer efficiency is most pronounced in a full-color image forming machine wherein a plurality of toner images are sequentially formed by development and transferred. More specifically, in the full-color image formation, typically four color toner images are liable to be ununiformly transferred especially in the case of using an intermediate transfer member, to result in color irregularity and color imbalance, thus making it difficult to stably produce high-quality full-color images.

In the case of using an intermediate transfer member for complying with various types of transfer-receiving materials, substantially two transfer steps are included so that the overall transfer efficiency is liable to be lowered. In a digital full-color copying machine or printer, a color image original is preliminarily color-separated by a B (blue) filter, a G (green) filter, and an R (red) filter to form latent image dots of 20–70 μm on a photosensitive member and develope them with respective color toners of Y (yellow), M (magenta), C (cyan) and Bk (black) to reproduce a multicolor image faithful to by subtractive color mixing. In this instance, on the photosensitive member on the intermediate transfer member, the Y toner, M toner, C toner and Bk toner are placed in large quantities corresponding to the color data of the original or CRT, so that the respective color toners are required to exhibit an extremely high transferability and the toner particles thereof are required to have shape factors SF-1 and SF-2 satisfying the above-mentioned conditions in order to realize such a high transferability.

Further, in order to faithfully reproduce minute latent image dots for realizing a high image quality, the toner particles may preferably have a weight-average particle size of 3–9 μm, more preferably 3–8 μm, and a variation coefficient (A) of at most 35% based on the number-basis distribution. Toner particles having a weight-average particle size of below 3 μm are liable to cause a lowering in transfer efficiency to leave much transfer residual toner particles on the photosensitive member and the intermediate transfer member, and further result in image irregularities due to fog and transfer failure. Toner particles having a weight-average particle size in excess of 9 μm are liable to cause melt-sticking onto the photosensitive member surface and other members inclusive of the intermediate transfer member. The difficulties are promoted if the toner particles have a number-basis particle size variation coefficient ($A_{NV}$) in excess of 35% as calculated by the following formula:

Variation coefficient $A_{NV}=[S/D_1]\times 100$, wherein S denotes a standard deviation in number-basis particle size distribution, and D1 denotes a number-average particle size (diameter) (μm), respectively of toner particles.

In the case of producing toner particles through a direct polymerization process, it is possible to control the average particle size and particle size distribution of the resultant toner particles by changing the species and amount of a hardly water-soluble inorganic salt or a dispersing agent functioning as a protective colloid; by controlling the mechanical process conditions, including stirring conditions such as a rotor peripheral speed, a number of passes and a stirring blade shape, and a vessel shape; and/or by controlling a weight percentage of solid matter in the aqueous dispersion medium.

In the toner production by direct polymerization, the monomer may comprise one or more vinyl monomers as enumerated above, and examples of the polymerization initiator may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while referring to their 10-hour half-life temperature.

In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may be produced by direct polymerization in the following manner. Into a polymerizable monomer, the wax, a colorant, a charge control agent, a polymerization initiator and another optional additive are added and uniformly dissolved or dispersed to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a latter stage of the polymerization. It is also possible to subject a part of the aqueous system to distillation in a latter stage of or after the polymerization in order to remove the yet-unpolymerized part of the polymerizable monomer and a by-product which can cause and odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In the toner particles prepared by the direct polymerization process, the wax may be dispersed in the form of (a) substantially spherical or spheroidal island(s) in an insoluble state within the binder resin as confirmed by observation of a particle section through a transmission electron microscope (TEM). By enclosing the wax within the toner particles in the above-described manner, it becomes possible to effectively prevent the deterioration of the toner particles and the soiling of the image forming apparatus thereof, so that the toner can retain good chargeability and can provide toner image with excellent reproducibility of latent image dots. Further, as the wax can effectively operates at the time of heat-pressure fixation, thereby providing improved low-temperature fixability and anti-high-temperature offset characteristic.

Figure 9A:
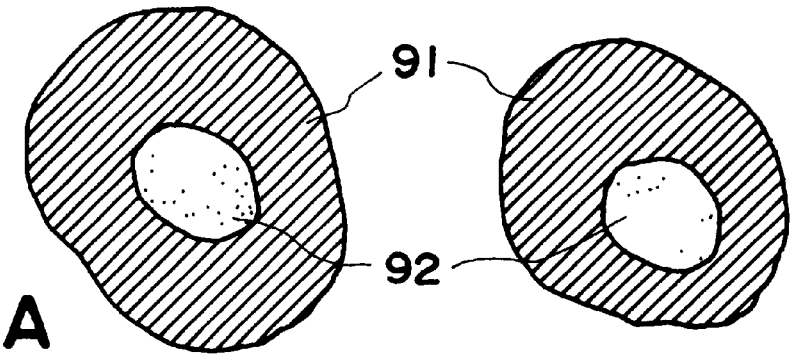
FIGS. 9A and 9B are respectively a sectional illustration of toner particles enclosing a wax component therein.
Figure 9B:
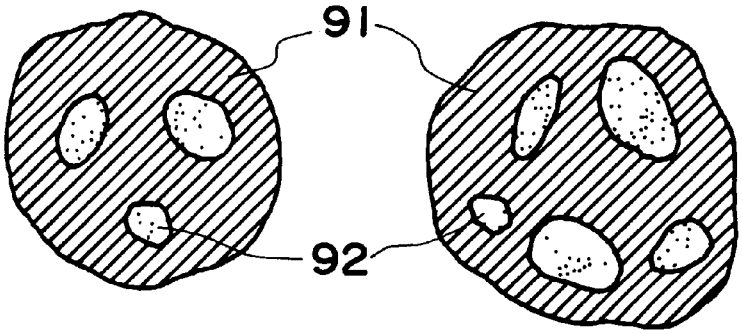

The cross-section of toner particles may be observed in the following manner. Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the wax and the outer resin by utilizing a difference in crystallinity therebetween. Two typical preferred cross-sectional states of toner particles are shown in FIGS. 9A and 9B, wherein the wax particle(s) 92 are enclosed within the binder resin 91.

A flowability-improving agent may be externally added to the toner particles so as to provide the toner particles with an improved flowability. Examples of the flowability-improving agent may include: fine powder of fluorine-containing resins, such as polyvinylidene fluoride and polytetrafluoroethylene; inorganic fine powders of silica such as wet-process silica and dry-process silica, titanium oxide and alumina, and treated products obtained by surface-treating these inorganic fine powders with one or more of a silane coupling agent, a titanate coupling agent and silicone oil.

A preferred class of the flowability-improving agent includes dry process silica or fumed silica obtained by vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 $\mu$m, particularly 0.002–0.2 $\mu$m.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

It is also possible to use a positively chargeable flowability-improving agent by treating the above-mentioned dry-process silica with an amino group-containing silane coupling agent or silicone oil as shown below:

$H_2NCH_2CH_2CH_2Si(OCH_3)_3$ $H_2NCH_2CH_2CH_2Si(CH_3)(OCH_3)_2$ $H_2NCONHCH_2CH_2CH_2Si(OC_2H_5)_3$ $H_2NCH_2CH_2NHCH_2CH_2NHCH_2CH_2CH_2Si(OCH_3)_3$ $H_5C_2OCOCH_2CH_2NHCH_2CH_2NHCH_2CH_2CH_2Si(OCH_3)_3$ $H_3COCOCH_2CH_2NHCH_2CH_2NHCH_2CH_2CH_2Si(OCH_3)_3$

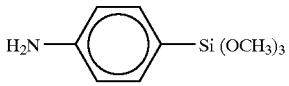

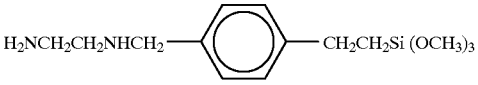

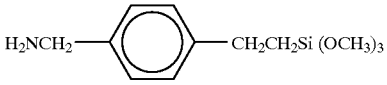

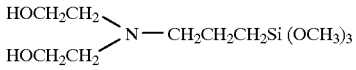

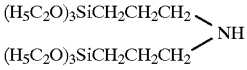

$H_2N(CH_2CH_2NH)_2CH_2CH_2CH_2Si(OCH_3)_3$ $H_2NCH_2CH_2CH_2Si(OC_2H_5)_3$ $H_2NCH_2CH_2NHCH_2CH_2CH_2Si(CH_3)(OCH_3)_2$ $H_2NCH_2CH_2NHCH_2CH_2CH_2Si(OCH_3)_3$ $H_3C_2OCOCH_2CH_2NHCH_2CH_2CH_2Si(OCH_3)_3$ $H_5C_2OCOCH_2CH_2NHCH_2CH_2NHCH_2CH_2NHCH_2CH_2NHCH_2CH_2CH_2Si(OCH_3)_3$

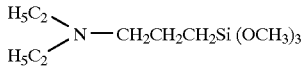

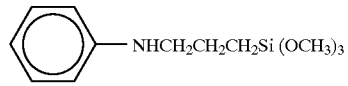

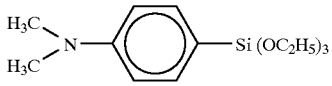

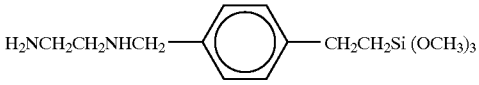

$(H_2CO)_3SiCH_2CH_2CH_2-NHCH_2$ $H_2CNHCH_2CH_2CH_2Si(OC_2H_5)_3$ $H_3C-NHCONHC_3H_6Si(OCH_3)_3$

As a silicone oil, it is possible to use dimethylsilane oil or an amino-modified silicone oil having a partial structure including an amino group in its side chain as shown below:

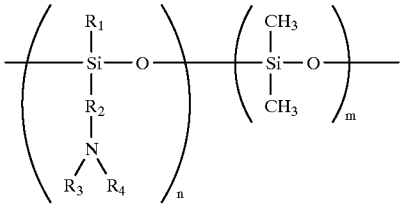

wherein $R_1$ denotes hydrogen, alkyl group, aryl group or alkoxy group; $R_2$ denotes alkylene group or phenylene group; $R_3$ and $R_4$ denote hydrogen, alkyl group or aryl group with the proviso that the alkyl group, aryl group, alkylene group and/or phenylene group can contain an amino group or another substituent, such as halogen, within an extent of not impairing the chargeability. m and n denote a positive integer.

Commercially available examples of the amino group-containing silicone oil may include the following:

| Trade name (Maker) | Viscosity at 25° C. (cPs) | Amine equivalent |
|---|---|---|
| SF8417 (Toray Silicone K.K.) | 1200 | 3500 |
| KF393 (Shin'Etsu Kagaku K.K.) | 60 | 360 |
| KF857 (Shin'Etsu Kagaku K.K.) | 70 | 830 |
| KF860 (Shin'Etsu Kagaku K.K.) | 250 | 7600 |
| KF861 (Shin'Etsu Kagaku K.K.) | 3500 | 2000 |
| KF862 (Shin'Etsu Kagaku K.K.) | 750 | 1900 |

-continued

| Trade name (Maker) | Viscosity at 25° C. (cPs) | Amine equivalent |
|---|---|---|
| KF864 (Shin'Etsu Kagaku K.K.) | 1700 | 3800 |
| KF865 (Shin'Etsu Kagaku K.K.) | 90 | 4400 |
| KF369 (Shin'Etsu Kagaku K.K.) | 20 | 320 |
| KF383 (Shin'Etsu Kagaku K.K.) | 20 | 320 |
| X-22-3680 (Shin'Etsu Kagaku K.K.) | 90 | 8800 |
| X-22-380D (Shin'Etsu Kagaku K.K.) | 2300 | 3800 |
| X-22-3801C (Shin'Etsu Kagaku K.K.) | 3500 | 3800 |
| X-22-3810B (Shin'Etsu Kagaku K.K.) | 1300 | 1700 |

The amine equivalent refers to a g-equivalent per amine which is equal to a value of the molecular weight of an amino group-containing silicone oil divided by the number of amino groups in the silicone oil.

The flowability-improving agent may have a specific surface area of at least 30 $m^2/g$, preferably at least 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner particles.

The toner particles according to the present invention may preferably have a weight-average particle size of 3–9 $\mu$m, more preferably 3–8 $\mu$m, in view of the resolution and the image density and can be well fixed under heating and pressure even at such a small particle size because of the specific wax contained therein.

The toner particles and the flowability-improving agent may be sufficiently blended with a blender, such as a Henschel mixer, to obtain a toner according to the present invention wherein fine particles of the flowability improving agent are carried in adhesion onto the toner particle surface.

The rheological properties and other properties and parameters characterizing the toner of the present invention referred to herein are generally based on values measured in the following manners.

(1-1) Rheological Properties of Toner and Binder Resin

Measurement is performed by using a viscoelasticity measurement apparatus ("Rheometer RDA-II", available from Rheometrics Co.).

Shearing means: Parallel plates having a diameter of 7.9 mm for a high-modulus sample or 40 mm for a low-modulus sample.

Measurement sample: A toner or a binder resin is heat-melted and then molded into a disk sample having a diameter of ca. 8 mm and a height of 2 –5 mm or a disk sample having a diameter of ca. 25 mm and a thickness of ca. 2–3 mm.

Measurement frequency: 6.28 radian/sec.

Setting of measurement strain: Initial value is set to 0.1%, and the measurement is performed according to an automatic measurement mode.

Correction for sample elongation: Performed by an automatic measurement mode.

Measurement temperature: Increased at a rate of 1° C./min, from 25° C. to 150° C.

(1-2) Melt-Viscosity of Wax

Measurement is similarly performed by using a viscoelasticity measurement apparatus ("Rheometer RDA-II", available from Rheometrics Co.).

Shearing means: A combination of a 40 mm-dia. disk plate and a 42 mm-dia. shallow cup.

Measurement sample: A wax is placed in the shallow cup in an amount sufficient to provide a thickness of 2–4 mm when melted.

Measurement conditions: Measurement is performed according to the steady flow measurement method by setting an initial shear speed at 0.1/sec and a final shear speed at 100/sec, and the value at a hear speed of 10/sec is taken as the viscosity of the wax.

(2) Maximum Heat-Absorption Temperature ($T_{MHA}$) of a Wax

Measurement may be performed in the following manner by using a differential scanning calorimeter ("DSC-7", available from Perkin-Elmer Corp.) according to ASTM D3418-82.

A sample in an amount of 2–10 mg, preferably about 5 mg, is accurately weighed.

The sample is placed on an aluminum pan and subjected to measurement in a temperature range of 30 –200° C. at a temperature-raising rate of 10° C./min in a normal temperature-normal humidity environment in parallel with a blank aluminum pan as a reference.

In the course of temperature increase, a main absorption peak appears at a temperature ($T_{MHA}$) in the range of 30–200° C. on a DSC curve. 40–100° C.

(3) Glass Transition Temperature (Tg) of a Binder Resin

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30 –200° C. at a temperature-raising rate of 10° C./min in a normal temperature-normal humidity environment in parallel with a blank aluminum pan as a reference.

In the course of temperature increase, a main absorption peak appears in the temperature region of 40–100° C.

In this instance, the glass transition temperature (Tg) is determined as a temperature of an intersection between a DSC curve and an intermediate line passing between the base lines obtained before and after the appearance of the absorption peak.

(4) Molecular Weight Distribution of a Wax

The molecular weight (distribution) of a wax may be measured by GPC under the following conditions:

Apparatus: "GPC-150C" (available from Waters Co.)

Column: "GMH-HT" 30 cm-binary (available from Toso K. K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

(5) Molecular Weight Distribution of a Binder Resin as a Starting Material or a THF-Soluble Content in a Toner The molecular weight (distribution) of a binder resin as a starting material or a THF-soluble content in a toner may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 $\mu$l of a GPC sample solution adjusted at a concentration of 0.05–0.6 wt. % is injected. In the case of a starting binder resin, the GPC sample solution may be prepared by passing the binder resin through a roll mill at 130° C. for 15 min. and dissolving the rolled resin in THF and, in the case of a toner sample, the GPC sample solution may be prepared by dissolving the toner in THF and then filtrating the solution through a 0.2 $\mu$m-filter to recover a THF-solution. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of $\mu$-styragel 500, $10^3$, $10^4$ and $10^5$ available from Waters Co.; or a combination of Shodex KA-801, 802, 803, 804, 805, 806 and 807 available from Showa Denko K.K.

(6) $^{13}$C-NMR Spectrum of a Wax

Measurement may be performed by using an FT-NMR (Fourier transform-nuclear magnetic resonance) apparatus ("JNM-EX400", available from Nippon Denshi K.K.) under the following conditions.

Measurement frequency: 100.40 MHz

Pulse condition: 5.0 $\mu$sec (45 deg.) according to the DEPT method

Data point: 32768

Delay time: 25 sec.

Frequency range: 10500 Hz

Integration times: 10000 times

Temperature: 110° C.

Sample: Prepared by placing 200 mg of a measurement sample in a 10 mm-dia. sample tube and dissolving it by adding a mixture solvent of benzene-$d_6$/o-dichlorobenzene-$d_4$ (¼) in a thermostat vessel at 110° C.

A portion giving as S/N (signal-to-noise) ratio of at least 1.5 relative to the base line is regarded as a peak on the spectrum curve.

Figure 2:
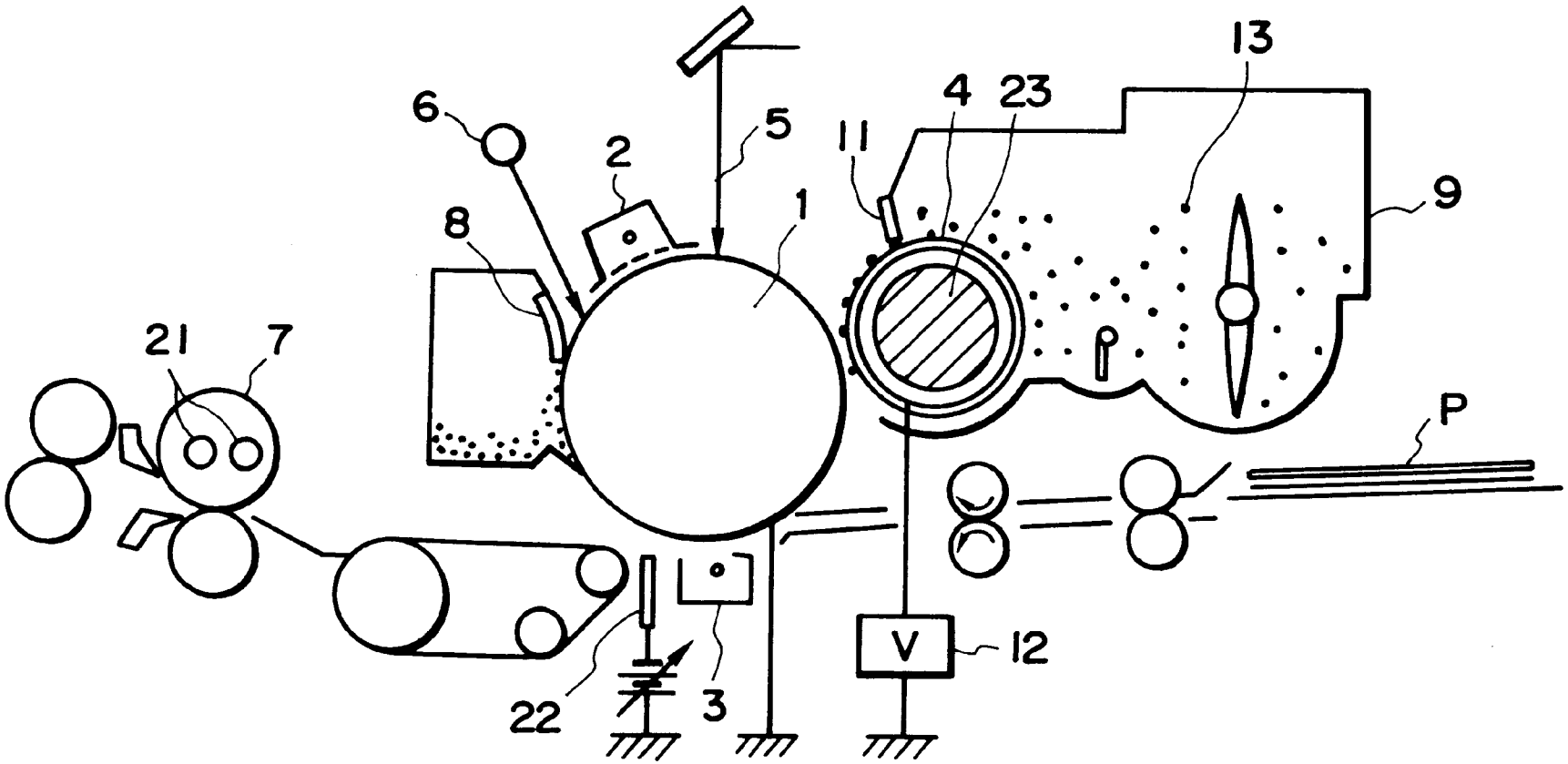
FIG. 2 illustrates an example of image forming apparatus to which the toner of the invention is applicable.

Now, an embodiment of the image forming method using a toner, particularly a magnetic toner, according to the present invention will be described with reference to FIGS. 2 and 3. The surface of an electrostatic image-bearing member (photosensitive member) 1 is charged to a negative potential or a positive potential by a primary charger 2 and exposed to image light 5 as by analog exposure or laser beam scanning to form an electrostatic image (e.g., a digital latent image as by laser beam scanning) on the photosensitive member. Then, the electrostatic image is developed with a magnetic toner 13 carried on a developing sleeve 4 according to a reversal development mode or a normal development mode. The toner 13 is initially supplied to a vessel of a developing device 9 and applied as a layer by a magnetic blade 11 on the developing sleeve 4 containing therein a magnet 23 having magnetic poles $N_1$, $N_2$, $S_1$ and $S_2$. At the development zone, a bias electric field is formed between the electroconductive substrate 16 of the photosensitive member 1 and the developing sleeve 4 by applying an alternating bias, a pulse bias and/or a DC bias voltage from a bias voltage application means to the developing sleeve 4.

The magnetic toner image thus formed on the photosensitive member 1 is transferred via or without via an intermediate transfer member onto a transfer-receiving material (transfer paper) P. When transfer paper P is conveyed to a transfer position, the back side (i.e., a side opposite to the photosensitive member) of the paper P is positively or negatively charged to electrostatically transfer the negatively or positively charged magnetic toner image on the photosensitive member 1 onto the transfer paper P. Then, the transfer paper P carrying the toner image is charge-removed by discharge means 22, separated from the photosensitive member 1 and subjected to heat-pressure fixation of the toner image by a hot pressure roller fixing device 7.

Residual magnetic toner remaining on the photosensitive member 1 after the transfer step is removed by a cleaning means comprising a cleaning blade 8. The photosensitive member 1 after the cleaning is charge-removed by erase exposure means 6 and then again subjected to an image forming cycle starting from the charging step by the primary charger 2.

Figure 3:
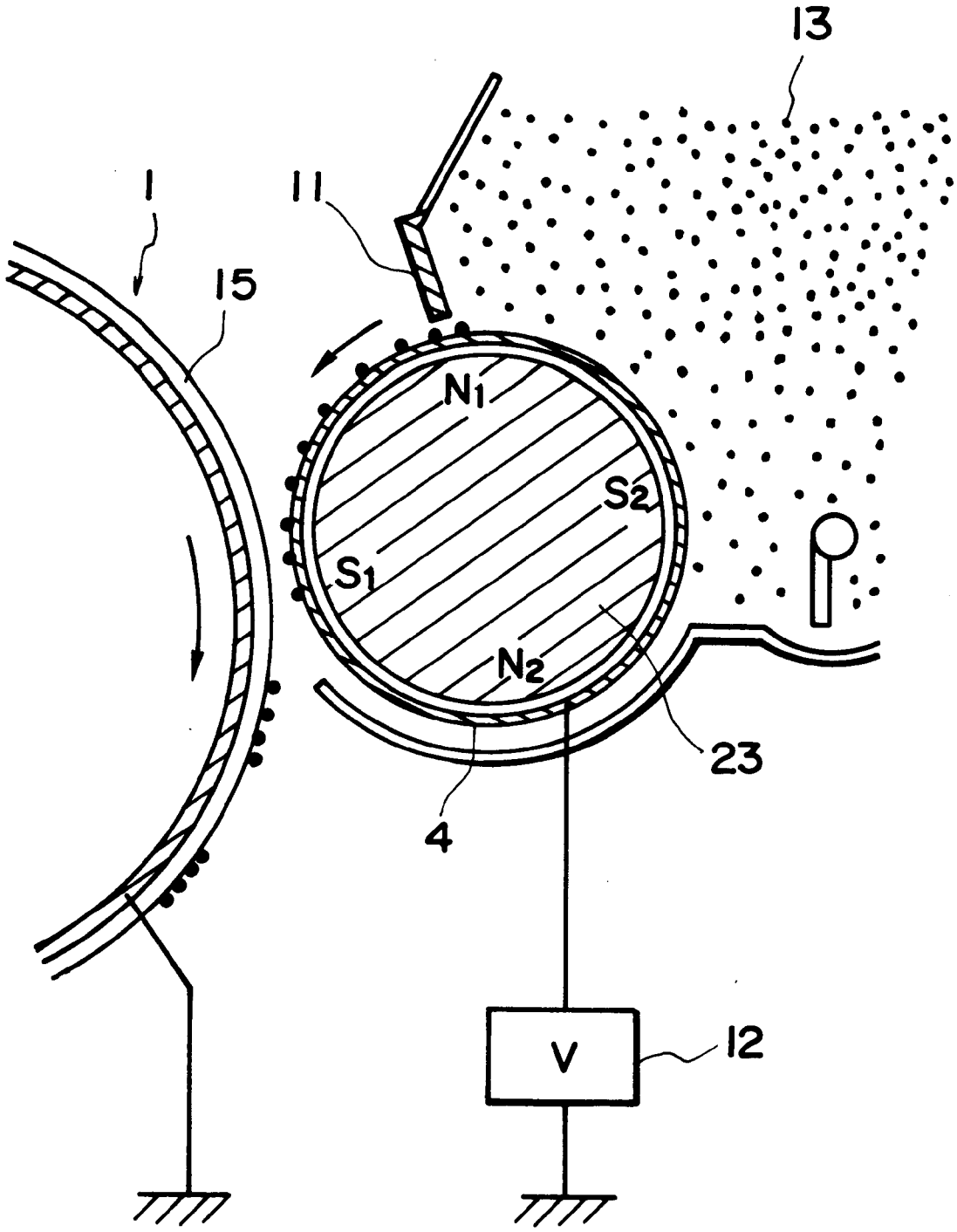
FIG. 3 is an enlarged illustration of a developing section of the image forming apparatus shown in FIG. 2.

The electrostatic image bearing or photosensitive member in the form of a drum 1 may comprise a photosensitive layer 15 formed on an electroconductive support 16 (FIG. 3). The non-magnetic cylindrical developing sleeve 4 is rotated so as to move in an identical direction as the photosensitive member 1 surface at the developing position. Inside the non-magnetic cylindrical developing sleeve 4, a multi-polar permanent magnet (magnet roll) 23 is disposed so as to be not rotated. The magnetic toner 13 in the developing device 9 is applied onto the developing sleeve 4 and provided with a triboelectric change due to friction between the developing sleeve 4 surface and the magnetic toner particles. Further, by disposing an iron-made magnetic blade 11 in proximity to (e.g., with a gap of 50–500 μm from) the developing sleeve 4 surface so as to be opposite to one magnetic pole of the multi-polar permanent magnet, the magnetic toner is controlled to be in a uniformly small thickness (e.g., 30–300 μm) that is identical to or smaller than the clearance between the photosensitive member 1 and the developing sleeve 4 at the developing position. The rotation speed of the developing sleeve 4 is controlled so as to provide a circumferential velocity identical or close to that of the photosensitive member 1 surface. The iron blade 11 as a magnetic doctor blade can be replaced by a permanent magnet so as to provide a counter magnetic pole. At the developing position, an AC bias or a pulse bias voltage may be applied to the developing sleeve 4 from a bias voltage application means. The AC bias voltage may preferably have a frequency 5 of 200–4,000 Hz and a peak-to-peak voltage Vpp of 500–3,000 volts.

Under the action of an electrostatic force on the photosensitive member surface and the AC bias or pulse bias electric field at the developing position, the magnetic toner particles are transferred onto an electrostatic image on the photosensitive member 1.

It is also possible to replace the magnetic blade with an elastic blade comprising an elastic material, such as silicone rubber, so as to apply a pressing force for applying a magnetic layer on the developing sleeve while regulating the magnetic toner layer thickness.

Another image forming method to which to toner according to the present invention is applicable will now be described with reference to FIGS. 4 and 5.

Figure 4:
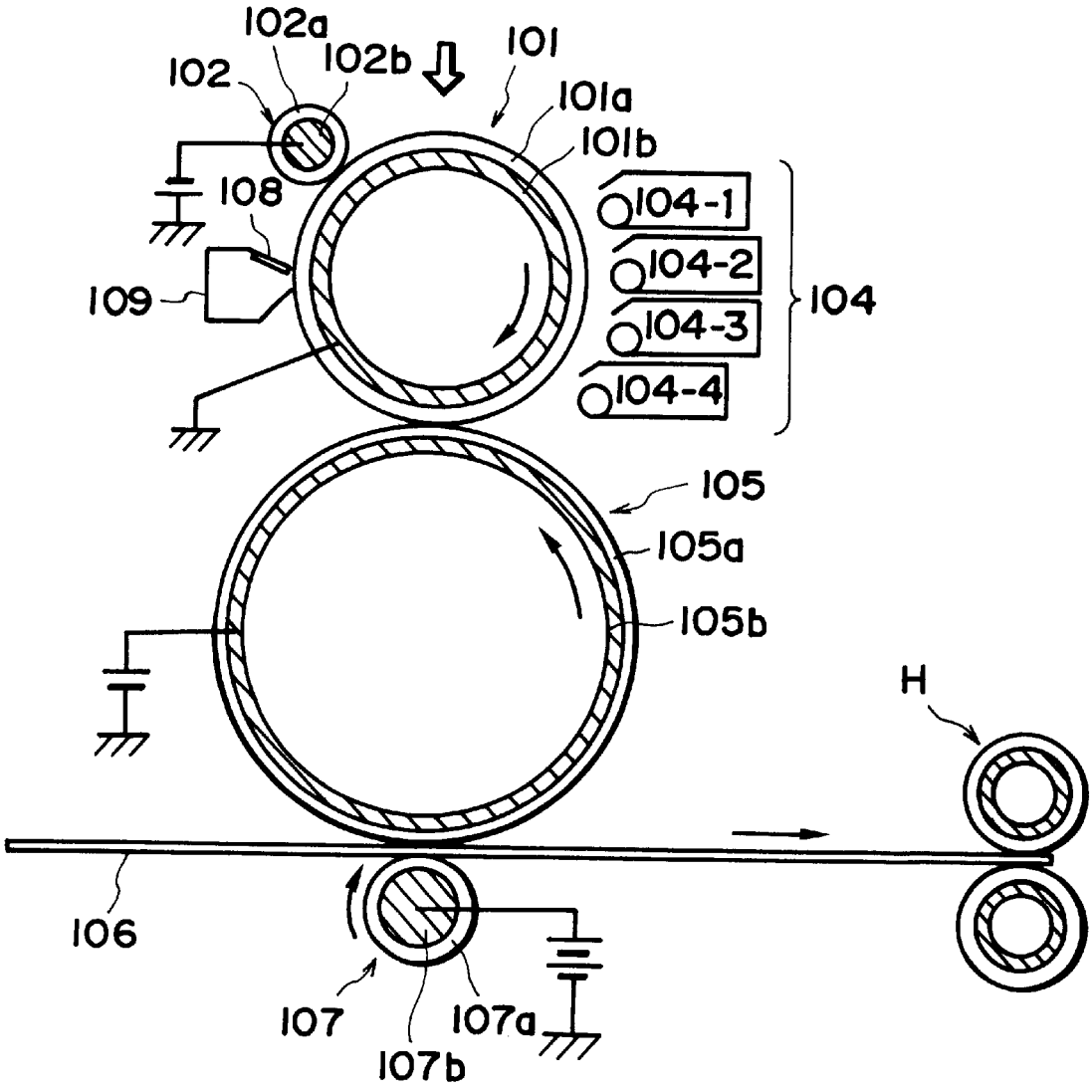
FIG. 4 illustrates another example of image forming apparatus to which the toner of the invention is applicable.

Referring to FIG. 4, an image forming apparatus principally includes a photosensitive member 101 as an electrostatic image-bearing member, a charging roller 102 as a charging means, a developing device 104 comprising four developing units 104-1, 104-2, 104-3 and 104-4, an intermediate transfer member 105, a transfer roller 107 as a transfer means, and a fixing device H as a fixing means.

Four developers comprising cyan toner particles, magenta toner particles, yellow toner particles, and black toner particles are incorporated in the developing units 104-1 to 104-4. An electrostatic image is formed on the photosensitive member 101 and developed with the four color toner particles by a developing method such as a magnetic brush developing system or a non-magnetic monocomponent developing system, whereby the respective toner images are formed on the photosensitive member 101.

Figure 5:
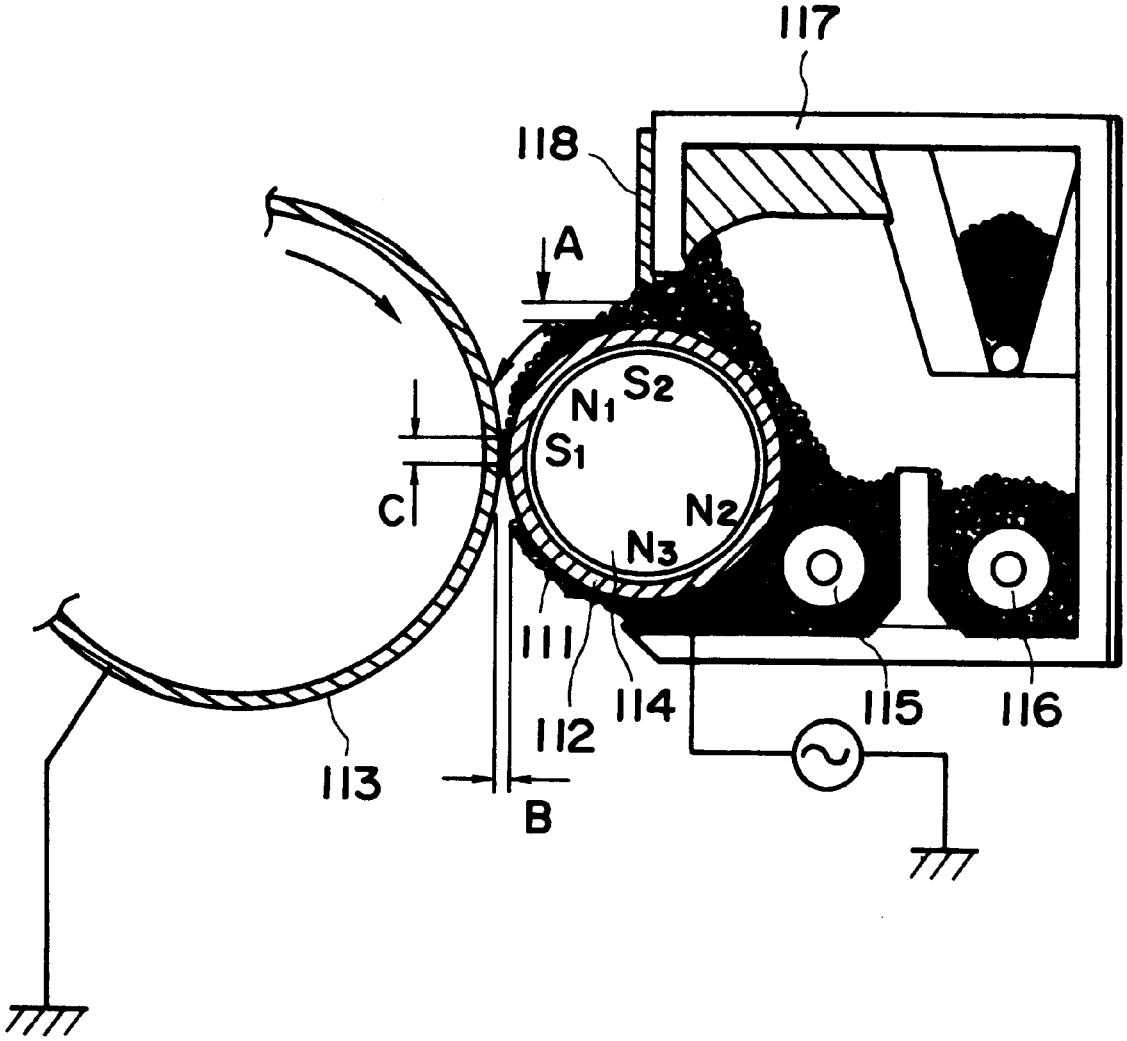
FIG. 5 is an enlarged sectional view of a developing apparatus using a two-component type developer used in an embodiment of the invention.

A non-magnetic toner according to the present invention may be blended with a magnetic carrier and may be used for development by using a developing means as shown in FIG. 5. It is preferred to effect a development in a state where a magnetic brush contacts a latent image-bearing member, e.g., a photosensitive drum 113 under application of an alternating electric field. A developer-carrying member (developing sleeve) 111 may preferably be disposed to provide a gap B of 100–1000 μm from the photosensitive drum 113 in order to prevent the toner attachment and improve the dot reproducibility. If the gap is narrower than 100 μm, the supply of the developer is liable to be insufficient to result in a low image density. In excess of 1000 μm, the lines of magnetic force exerted by a developing pole S1 is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 111 with the photosensitive drum 113 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 118 and the developing sleeve 111 and/or changing the gap B between the developing sleeve 111 and the photosensitive drum 113.

In formation of a full color image for which a halftone reproducibility is a great concern may be performed by using at least 3 developing devices for magenta, cyan and yellow, adopting the toner according to the present invention and preferably adopting a developing system for developing digital latent images in combination, whereby a development faithful to a dot latent image becomes possible while avoiding an adverse effect of the magnetic brush and disturbance of the latent image. The use of the toner according to the present invention is also effective in realizing a high transfer ratio in a subsequent transfer step. As a result, it becomes possible to high image qualities both at the halftone portion and the solid image portion.

In addition to the high image quality at an initial stage of image formation, the use of the toner according to the present invention is also effective in avoiding the lowering in image quality in a continuous image formation on a large number of sheets.

Figure 6:
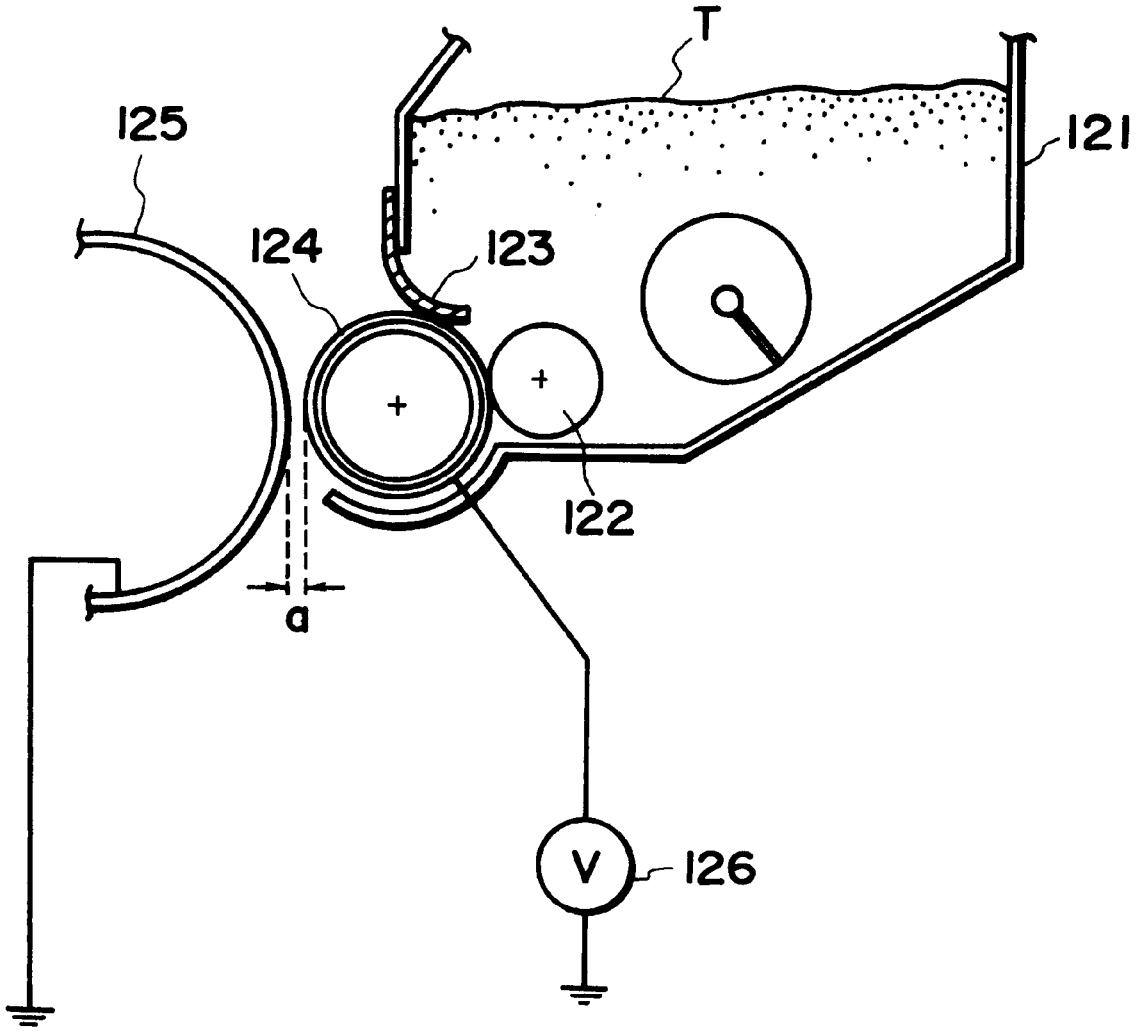
FIG. 6 is an enlarged sectional view of a developing apparatus using a mono-component type developer used in another embodiment of the invention.

The toner according to the present invention may also be realized as a non-magnetic or magnetic toner for a mono-component development method. FIG. 6 illustrates an example for such a development apparatus.

Referring to FIG. 6, an electrostatic image formed on an electrostatic image-bearing member 125 by electrophotography or electrostatic recording may be developed with a toner T contained in a toner vessel 121 and applied on a non-magnetic developing sleeve (toner-carrying member) 124 comprising aluminum or stainless steel.

Almost a right half circumference of the developing sleeve is caused to always contact the toner T stored in the toner vessel 121, and the toner in proximity to the developing sleeve 124 is attached to and carried on the developing sleeve 124 under the action of a magnetic force generated by a magnetic field-generating means in the developing sleeve and/or an electrostatic force.

The toner carrying member 124 may have a surface roughness Ra set to 1.5 $\mu$m or smaller, preferably 1.0 $\mu$m or smaller, further preferably 0.5 $\mu$m or smaller.

By setting the surface roughness Ra to at most 1.5 $\mu$m, the toner particle-conveying force of the toner carrying member is suppressed to allow the formation of a thin toner layer on the toner-carrying and increase the number of contents between the toner carrying member and the toner, to thereby improve the toner chargeability.

In case where the surface roughness Ra of the toner carrying member exceeds 1.5, it become difficult to form a thin layer of toner on the toner carrying member and improve the toner chargeability, so that the improvement in image quality becomes difficult to realize.

The surface roughness Ra of the toner carrying member refers to a center line-average roughness as measured by a surface roughness tester ("Surfcoder SE-30H", available from K.K. Kosaka Kenkyusho) according to JIS B0601. More specifically, the surface roughness Ra may be determined by taking a measurement length a of 2.5 mm along a center lien (taken on an x-axis) and taking a roughness on a y-axis direction to represent the roughness curve by a function of y=f(x) to calculate a surface roughness Ra ($\mu$m) from the following equation:

$$Ra=(1/a)\int_0^a|f(x)|dx.$$

The toner carrying member may preferably comprise a cylinder or a belt of stainless steel, aluminum, etc., which may be surface-coated with a metal, a resin, or a resin containing fine particles of a resin, a metal, carbon black or a charge control agent.

If the surface-moving velocity of the toner-carrying member is set to be 1.05–3.0 times the surface moving speed of the electrostatic image-bearing member, the toner layer on the toner-carrying member receives an appropriate degree of stirring effect to realize a better faithful reproduction of an electrostatic image.

If the surface speed of the toner carrying member is below 1.05 times that of the electrostatic image-bearing member, such a toner layer stirring effect is insufficient, so that it becomes difficult to expect a good image formation. Further, in the case of forming a solid image requiring a large amount of toner over a wide area, the toner supply to the electrostatic image is liable to be insufficient to result in a lower image density. On the other hand, in excess of 3.0, the toner is liable to be excessively charged and cause difficulties, such as toner deterioration or sticking onto the toner-carrying member (developing sleeve).

The toner T stored in the hopper (toner vessel) 121 is supplied to the developing sleeve 124 by means of a supply member 122. The supply member may preferably be in the form of a supply roller comprising a porous elastic material or a foam material, such as soft polyurethane foam. The supply roller 122 is rotated at a non-zero relative velocity in a forward or reverse direction with respect to the developing sleeve, whereby the peeling of the toner (a portion of the toner not used for development) from the developing sleeve simultaneously with the toner supply to the developing sleeve. In view of the balance between the toner supply and toner peeling, the supply roller 122 may preferably be abutted to the developing sleeve in a width of 2.0–10.0 mm, more preferably 4.0–6.0 mm. On the other hand, a large stress is liable to be applied to the toner to promote the toner deterioration or agglomeration or melt-sticking of the toner onto the developing sleeve and the supply roller, but, as the toner according to the present invention is excellent in flowability, releasability and durability, so that the toner is suitably used in the developing method using such a supply roller. The supply member can also comprise a brush member of resinous fiber of, e.g., nylon or rayon. The use of such a supply member is very effective for a non-magnetic monocomponent toner not capable of utilizing a magnetic constraint forth for toner application but can also be applicable to a monocomponent development method using a magnetic monocomponent method.

The toner supplied to the developing sleeve can be applied uniformly in a thin layer by a regulation member. The thin toner layer-regulating member may comprise a doctor blade, such as a metal blade or a magnetic blade, disposed with a certain gap from the developing sleeve, or alternatively may comprise a rigid roller or a sleeve of a metal, a resin or a ceramic material, optionally including therein a magnetic field generating means.

Alternatively, it is also possible to constitute such a thin toner layer-regulating member as an elastic member, such as an elastic blade or an elastic roller, for applying a toner under pressure. FIG. 6, for example, shows an elastic blade 123 fixed at its upper but root portion to the developer vessel 121 and having its lower free length portion pressed at an appropriate pressure against the developing sleeve so as to extend in a reverse direction (as shown or in a forward direction). By using such an application means, it becomes possible to form a tight toner layer stable against an environmental change.

The elastic material may preferably comprise a material having an appropriate chargeability position in a triboelectric chargeability series so as to charge the toner to an appropriate polarity and may for example comprise: an elastomer, such as silicone rubber, urethane rubber or NBR; an elastic synthetic resin, such as polyethylene terephthalate; an elastic metal, such as stainless steel, steel and phosphor bronze; or a composite material of these.

In the case of providing a durable elastic member, it is preferred to use a laminate of an elastic metal and a resin or rubber or use a coated member.

Further, the elastic material can contain an organic material or an inorganic material added thereto, e.g., by melt-mixing or dispersion. For example, by adding a metal oxide, a metal powder, a ceramic, carbon allotrope, whisker, inorganic fiber, dye, pigment or a surfactant, the toner chargeability can be controlled. Particularly, in the case of using an elastic member formed of a rubber or a resin, it is preferred to add fine powder of a metal oxide, such as silica, alumina, titania, tin oxide, zirconia oxide or zinc oxide; carbon black; or a charge control agent generally used in toners.

Further, by applying a DC and/or AC electric field to the blade regulation member, or the supply roller or brush member, it becomes possible to exert a disintegration action onto the toner layer, particularly enhance the uniform thin layer application performance and uniform chargeability at the regulating position, and the toner supply/peeling position at the supply position, thereby providing increased image density and better image quality.

The elastic member may be abutted against the toner-carrying member at an abutting pressure of at least 0.1 kg/m, preferably 0.3–25 kg/m, further preferably 0.5–12 kg/m, in terms of a linear pressure in the direction of a generatrix of the toner-carrying member. As a result, it becomes possible to effectively disintegrate the toner to realize a quick charging of the toner. If the abutting pressure is below 0.1 kg/m, the uniform toner application becomes difficult to result in a broad toner charge distribution leading to fog and scattering. Above 25 kg/m, an excessive pressure is applied to the toner to cause toner deterioration or toner agglomeration, and a large torque becomes necessary for driving the toner-carrying member.

It is preferred to dispose the electrostatic image-bearing member 125 and the toner-carrying member 124 with a gap $\alpha$ of 50–500 $\mu$m, and a doctor blade may disposed with a gap of 50–400 $\mu$m from the toner-carrying member.

It is generally most preferred that the toner layer thickness is set to be thinner than the gap between the electrostatic image-bearing member and the toner carrying member, but the toner layer thickness can be set so that a portion of toner ears constituting the toner layer contacts the electrostatic image-bearing member.

Further, by forming an alternating electric field between the electrostatic image-bearing member and the toner-carrying member from a bias voltage supply 126, it becomes possible to facilitate the toner movement from the toner-carrying member to the electrostatic image-bearing member, thereby providing a better quality of images. The alternating electric field may comprise a peak-to-peak voltage Vpp of at least 100 volts, preferably 200–3000 volts, further preferably 300–2000 volts, and a frequency f of 500 –5000 Hz, preferably 1000–3000 Hz, further preferably 1500–3000 Hz. The alternating electric field may comprise a waveform of a rectangular wave, a sinusoidal wave, a sawteeth wave or a triangular wave. Further, it is also possible to apply an asymmetrical AC bias electric field having a positive wave portion and a negative wave portion having different voltages and durations. It is also preferred to superpose a DC bias component.

Referring again to FIG. 4, the electrostatic image-bearing member 101 may comprise a photosensitive drum (or a photosensitive belt) comprising a layer of a photoconductive insulating material, such as a-Se, CdS, $ZnO_2$, OPC (organic photoconductor), and a-Si (amorphous silicon). The electrostatic image-bearing member 101 may preferably comprise an a-Si photosensitive layer or OPC photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

A charging step may be performed by using a corona charger which is not in contact with the photosensitive member 1 or by using a contact charger, such as a charging roller. The contact charging as shown in FIG. 4 may preferably be used in view of efficiency of uniform charging, simplicity and a lower ozone-generating characteristic.

The charging roller 102 comprises a core metal 102*b* and an electroconductive elastic layer 102*a* surrounding a periphery of the core metal 102*b*. The charging roller 102 is pressed against the photosensitive member 101 at a prescribed pressure (pressing force) and rotated mating with the rotation of the photosensitive member 101.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

The toner image formed on the electrostatic image-bearing member 101 is transferred to an intermediate transfer members 5 to which a voltage (e.g., ±0.1–±5 kV) is applied. The surface of the electrostatic image-bearing member may then be cleaned by cleaning means 109 including a cleaning blade 108.

The intermediate transfer member 105 comprises a pipe-like electroconductive core metal 105*b* and a medium resistance-elastic layer 105*a* (e.g., an elastic roller) surrounding a periphery of the core metal 105*b*. The core metal 105*b* can comprise a plastic pipe coated by electroconductive plating. The medium resistance-elastic layer 105*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 105 is disposed under the electrostatic image-bearing member 101 so that it has an axis (or a shaft) disposed in parallel with that of the electrostatic image-bearing member 101 and is in contact with the electrostatic image-bearing member 101. The intermediate transfer member 105 is rotated in the direction of an arrow (counterclockwise direction) at a peripheral speed identical to that of the electrostatic image-bearing member 101.

The respective color toner images are successively intermediately transferred to the peripheral surface of the intermediate transfer member 105 by an elastic field formed by applying a transfer bias to a transfer nip region between the electrostatic image-bearing member 101 and the intermediate transfer member 105 at the time of passing through the transfer nip region.

After the intermediate transfer of the respective toner image, the surface of the intermediate transfer member 105 is cleaned, as desired, by a cleaning means which can be attached to or detached from the image forming apparatus. In case where the toner image is placed on the intermediate transfer member 105, the cleaning means is detached or released from the surface of the intermediate transfer member 105 so as not to disturb the toner image.

The transfer means (e.g., a transfer roller) 107 is disposed under the intermediate transfer member 105 so that it has an axis (or a shaft) disposed in parallel with that of the intermediate transfer member 105 and is in contact with the intermediate transfer member 105. The transfer means (roller) 107 is rotated in the direction of an arrow (clockwise direction) at a peripheral speed identical to that of the intermediate transfer member 105. The transfer roller 107 may be disposed so that it is directly in contact with the intermediate transfer member 105 or in contact with the intermediate transfer member 105 via a belt, etc. The transfer roller 107 may comprise an electroconductive elastic layer 107*a* disposed on a peripheral surface of a core metal 107*b*.

The intermediate transfer member 105 and the transfer roller 107 may comprise known materials as generally used. By setting the volume resistivity of the elastic layer 105*a* of the intermediate transfer member 105 to be higher than that of the elastic layer 107*b* of the transfer roller, it is possible to alleviate a voltage applied to the transfer roller 107. As a result, a good toner image is formed on the transfer-receiving material and the transfer-receiving material is prevented from winding about the intermediate transfer member 105. The elastic layer 105*a* of the intermediate transfer member 105 may preferably have a volume resistivity at least ten times that of the elastic layer 107*b* of the transfer roller 107.

The transfer roller 107 may comprise a core metal 107*b* and an electroconductive elastic layer 107*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 107*b* by a constant-voltage supply.

The toner according to the present invention exhibits a high transfer efficiency in the transfer steps to leave little transfer residual toner and also exhibits excellent cleanability, so that it does not readily cause filming on the electrostatic image-bearing member. Further, even when subjected to a continuous image formation test on a large number of sheets, the toner according to the present invention allows little embedding of the external additive at the toner particle surface, so that it can provide a good image quality for a long period. Particularly, the toner according to the present invention can be suitably used in an image forming apparatus equipped with a re-use mechanism wherein the transfer residual toner on the electrostatic image-bearing member and the intermediate transfer member is recovered and re-used for image formation.

Figure 7:
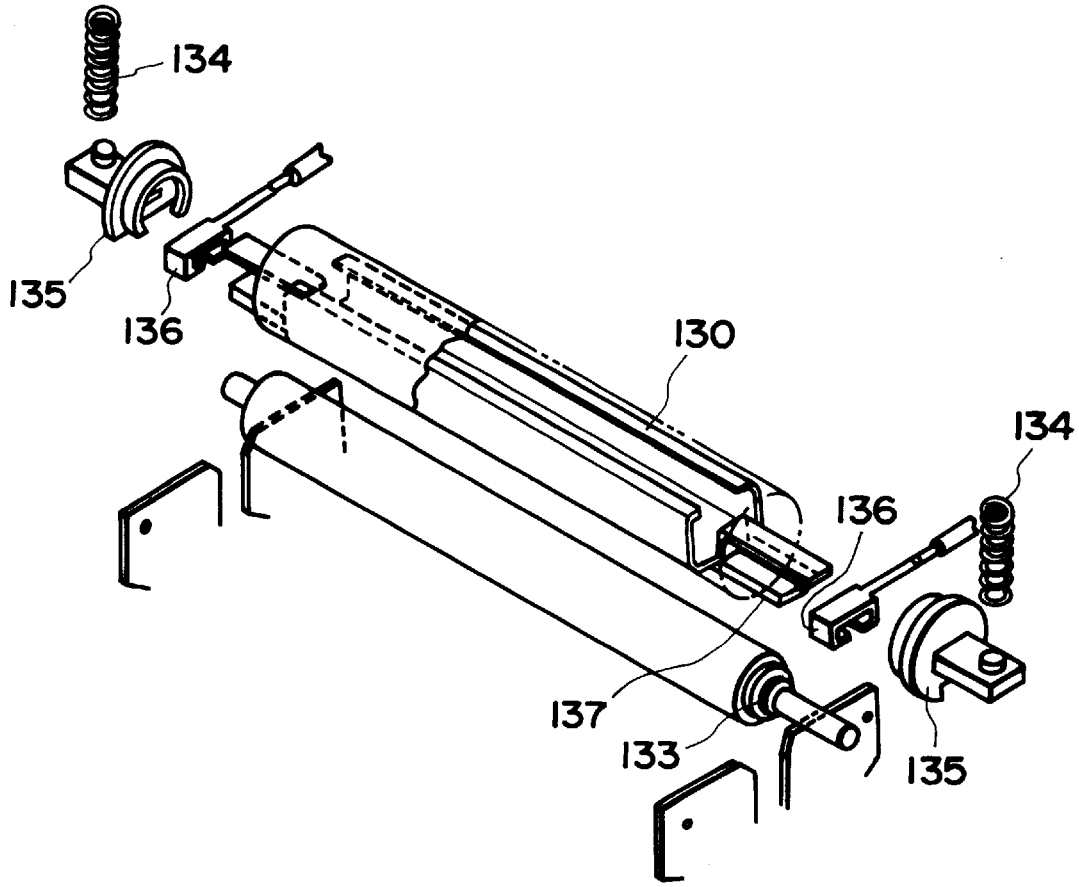
FIG. 7 is an exploded perspective view of essential parts of a fixing apparatus used in an embodiment of the invention.
Figure 8:
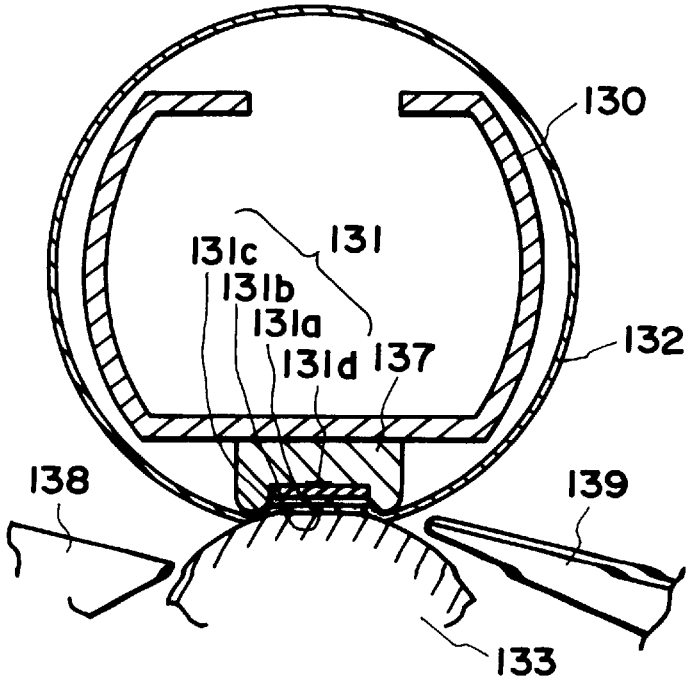
FIG. 8 is an enlarged sectional view of the fixing apparatus including a film in a non-driven state.

The transfer-receiving material 106 carrying the transferred toner image is then conveyed to heat-pressure fixation means, inclusive of a hot roller fixation device comprising basically a heating roller enclosing a heat-generating member, such as a halogen heater, and a pressure roller comprising an elastic material pressed against the heating roller, and a hot fixation device for fixation by heating via a film (as shown in FIGS. 7 and 8, wherein reference numeral 130 denotes a stay; 131, a heating member; 131*a*, a heater substrate; 131*b*, a heat-generating member; 131*c*, a surface protective layer; 131*d*, a temperature-detecting element; 132, a fixing film; 133, a pressing roller; 134, a coil spring; 135, a film edge-regulating member; 136, an electricity-supplying connector; 137, an electricity interrupting member; 138, an inlet guide; and 139, an outlet guide (separation guide). As the toner according to the present invention has excellent fixability and anti-offset characteristic, the toner is suitably used in combination with such a heat-pressure fixation device.

Hereinbelow, the present invention will be described more specifically based on Examples.

EXAMPLE 1

A toner was prepared from the following ingredients including Branched wax No. 1 which exhibited properties shown in Table 1 and provided a $^{13}$C-NMR spectrum shown in FIG. 1.

| | |
|---|---|
| Binder resin (styrene-butyl acrylate copolymer) [Mw = 215000, Mw/Mn = 49.7, Tg = 60° C.; a main peak and a sub-peak of molecular weights of 8,300 and 648,000, respectively] | 100 wt. parts |
| Magnetic material (Dav. (average particle size) = 0.2 μm) | 90 wt. parts |
| Mono-azo metal complex (negative charge control agent) | 2 wt. parts |
| Branched wax No. 1 | 4 wt. parts |

The above ingredients were pre-blended by a Henschel mixer and melt-kneaded through a twin-screw kneading extruder at 130° C. The kneaded product was cooled by standing, coarsely crushed by a cutter mill, pulverized by a fine pulverizer using a jet air stream and classified by a pneumatic classifier to obtain negatively chargeable insulating magnetic toner particles having a weight-average particle size ($D_4$) of 6.4 μm. To 100 wt. parts of the magnetic toner particles, 1.0 wt. part of negatively chargeable hydrophobic dry-process silica ($S_{BET}$(BET specific surface area)= 300 $m^2/g$) was externally added and blended by a Henschel mixer to provide Magnetic toner (1) of insulating and negative chargeability.

For measurement of rheological properties, Magnetic toner (1) was heat-melted to form a cylindrical sample having a diameter of ca. 8 mm and a height of 3 mm. The sample was set on serrated parallel plates having a diameter of 7.9 mm and subjected to measurement of storage modulus and loss modulus at varying temperatures.

For evaluation of the wax dispersion state, Magnetic toner (1) was observed through an optical microscope equipped with a polarizer at a low magnification of ca. 60, so that ca. 900 magnetic toner particles were observed in one view field, whereby only 7–8 bright spots indicating the presence of isolated wax particles were observed in one view field, thus showing good dispersibility of the wax.

Magnetic toner (1) was evaluated by a continuous image formation on $2\times10^5$ sheets by using a digital copying machine ("GP-5", available from Canon K.K.).

The digital copying machine included a photosensitive drum comprising a 30 mm-dia. aluminum cylinder coated with an OPC photosensitive layer. The photosensitive drum was charged at −700 volts by a primary charger and subjected to image scanning with laser light to form a digital latent image, which was then developed with Magnetic toner (1) negatively triboelectrically charged on a developing sleeve enclosing a fixed magnet having four magnetic poles including a developing pole of 950 Gauss according to a reversal development mode.

The developing sleeve was supplied a DC bias voltage of −600 volts superposed with an AC bias voltage of Vpp=800 volts and f=1800 Hz. The resultant magnetic toner image on the photosensitive drum was electrostatically transferred onto plain paper and, after charge removal, the plain paper separated from the photosensitive drum and carrying the toner image was subjected to fixation by means of a heat-pressure fixing device comprising a heating roller and a pressure roller.

The resultant images showed an image density of 1.33 at the initial stage (on 1st to 10th sheets) and 1.35 at the time of completing the image formation on $2\times10^5$ sheets, thus showing substantially no change. The images showed no image quality changes, such as scattering or thickening of line images. After the continuous image formation on $2\times10^5$ sheets, the OPC photosensitive drum was checked by careful observation, whereas no attachment of isolated wax or noticeable damage on the OPC photosensitive drum was observed. The resultant images either showed no image defects attributable to damages on the OPC photosensitive drum surface.

Then, the fixing device in the digital copying machine was taken out and equipped with an external drive mechanism so as to provide a fixing roller process speed of 150 mm/sec and a temperature controller so as allow variable fixing roller temperatures in the range of 100–250° C.

A fixing test was performed with respect to the magnetic toner images transferred onto plain papers in the above-descried manner after the upper roller (heating roller) reached a prescribed temperature and then the temperature was further retained for 10 min. so as to sufficiently heat the lower roller (pressure roller) to confirm a uniform temperature.

As a result of the above-mentioned fixing test, the Magnetic toner showed a lowest fixable temperature (giving a density lowering of at most 20% by rubbing with lens-cleaning paper) of 130° C. and did not cause hot-offset up to a fixing temperature of 230° C., thus showing good anti-hot-offset characteristic.

Further, 100 g of Magnetic toner (1) was placed in a plastic cup and left standing for 10 hours in a thermostat vessel controlled at 50° C., as an anti-blocking test. As a result, the toner exhibited slight agglomeration was however immediately disintegrated to recover good flowability.

The methods and standards of evaluation are supplemented hereinbelow, and the results of the evaluation are shown in Table 2 together with those obtained for other Examples and Comparative Examples.

[Evaluation Method]

1) Anti-Blocking Test 100 g of a sample magnetic toner was placed in a plastic cup and left standing at 50° C. for 10 days. The toner state thereafter was observed with eyes and evaluated according to the following standard.

Rank 5: No change.

Rank 4: Agglomerate was observed but could be immediately disintegrated.

Rank 3: Agglomerate was difficult to disintegrate.

Rank 2: No flowability.

Rank 1: Clear caking occurred.

2) Image Density

A maximum image density of a solid black portion (portion free from edge effect) was measured by a densitometer ("Macbeth RD 918", available from Macbeth Co.)

3) Wax Dispersibility in Toner

Each toner sample was observed through an optical microscope equipped with a polarizer at a low magnification of ca. 60 and a number of bright spots indicate isolated wax particles per 900 toner particles was counted to evaluate the wax dispersibility according to the following standard:

Rank 5: No bright spots.

Rank 4: 1–10 bright spots.

Rank 3: 11–20 bright spots.

Rank 2: 21–50 bright spots.

Rank 1: 51 or more bright spots.

TABLE 1

| Wax | $T_{MHA}$ on DSC (° C.) | $\eta_1/\eta_2$ | $(S_2/S) \times 100$ | $(S_2/S) \times 100$ | $S_2/S_1$ | Number of $S_2$ peaks | Mw | Mn | Mw/Mn |
|---|---|---|---|---|---|---|---|---|---|
| Branched No. 1 | 74 | 1.8 | 3.9 | 8.1 | 2.1 | 4 | 14300 | 1280 | 11.2 |
| Branched No. 2 | 92 | 1.4 | 4.6 | 8.3 | 1.8 | 3 | 15600 | 1020 | 15.3 |
| Branched No. 3 | 69 | 2.6 | 2.3 | 5.9 | 2.6 | 1 | 1530 | 230 | 6.6 |
| Branched No. 4 | 105 | 1.1 | 5.2 | 8.8 | 1.7 | 3 | 19700 | 1040 | 18.7 |
| Branched No. 5 | 71 | 2.0 | 4.0 | 8.4 | 2.1 | 4 | 12700 | 960 | 13.2 |
| Branched No. 6 | 96 | 1.7 | 10.0 | 15.0 | 1.5 | 3 | 17400 | 1130 | 15.4 |
| Branched No. 7 | 125 | 1.2 | 2.2 | 4.7 | 2.1 | 2 | 22300 | 1100 | 20.3 |
| Branched No. 8 | 52 | 3.2 | 1.0 | 1.5 | 1.5 | 1 | 1260 | 215 | 5.9 |
| Comparative No. 1 | 48 | 78.0 | 0 | 0.1 | — | 1 | 390 | 310 | 1.3 |
| Comparative No. 2 | 136 | 30.0 | 2.2 | 0 | 0 | 1 | 8890 | 1010 | 8.8 |
| Comparative No. 3 | 110 | 2.6 | 0.5 | 0.1 | 0.2 | 1 | 1640 | 1370 | 1.2 |
| Comparative No. 4 | 134 | 35.0 | 0.6 | 0.1 | 0.17 | 0 | 8700 | 980 | 8.9 |
| Comparative No. 5 | 76 | 29.0 | 0.4 | 0.2 | 0.5 | 1 | 620 | 475 | 1.3 |
| Comparative No. 6 | 118 | 17.0 | 0.9 | 1.3 | 1.4 | 1 | 1970 | 820 | 2.4 |
| Comparative No. 7 | 121 | 12.0 | 11.5 | 19.4 | 1.7 | 5 | 6350 | 870 | 7.3 |
| Comparative No. 8 | 95 | 26.0 | 0.7 | 1.2 | 1.7 | 1 | 1100 | 750 | 1.5 |
| Comparative No. 9 | 139 | 6.9 | 3.6 | 16.0 | 4.4 | 4 | 14200 | 1180 | 12.0 |
| Comparative No. 10 | 129 | 22 | 1.6 | 1.3 | 0.8 | 1 | 2270 | 840 | 2.7 |

In Table 1, Branched waxes Nos. 1 to 8 and Comparative Examples Nos. 6 to 10 were waxes prepared by copolymerizing α-monoolefinic hydrocarbons and ethylene in various ratios. Comparative wax No. 1 was polyethylene wax, Comparative wax No. 2 was polypropylene wax, Comparative wax No. 3 was ethylene-propylene copolymer wax (copolymerization wt. ratio=90:10), Comparative wax No. 4 was propylene-ethylene copolymer wax (copolymerization wt. ratio=90:10), and Comparative wax No. 5 was paraffin wax.

Comparative Examples 1 to 10

Comparative magnetic toners (1) to (10) were prepared in the same manner as in Example 1 except for using Comparative waxes Nos. 1 to 10 instead of Branched wax No. 1, and evaluated in the same manner as in Example 1.

EXAMPLE 2

100 wt. parts of Binder resin and 4 wt. parts of Branched wax No. 1 respectively used in Example 1 were added to 200 wt. parts of xylene. After it was confirmed that Binder resin was dissolved and Branched wax No. 1 was uniformly dispersed in xylene, the system was heated under vacuum to evaporate off the xylene to obtain a binder resin containing Branched wax No. 1 as uniformly dispersed fine particles.

Magnetic toner (2) was prepared by using the above-prepared wax-dispersed binder resin otherwise in the same manner as in Example 1, and evaluated in the same manner as in Example 1.

EXAMPLE 3

Magnetic toner (3) was prepared and evaluated in the same manner as in Example 1 except for using 4 wt. parts of Branched wax No. 1 and 3 wt. parts of Comparative wax No. 2 instead of 4 wt. parts of Branched wax No. 1.

EXAMPLE 4

Magnetic toner (4) was prepared and evaluated in the same manner as in Example 1 except for using 4 wt. parts of Branched wax No. 2 and 3 wt. parts of Comparative wax No. 5 instead of 4 wt. parts of Branched wax No. 1.

EXAMPLE 5

Magnetic toner (5) was prepared and evaluated in the same manner as in Example 1 except for using 4 wt. parts of Branched wax No. 4 and 2 wt. parts of Branched wax No. 3 instead of 4 wt. parts of Branched wax No. 1.

EXAMPLE 6

Magnetic toner (6) was prepared and evaluated in the same manner as in Example 1 except for using 100 wt. parts of a polyester resin (Mw=48100, Mw/Mn =5.4, Tg=62.0° C.) prepared from terephthalic acid, fumaric acid, trimellitic acid, bisphenol propoxy-adduct and bisphenol ethoxy-adduct, and 4 wt. parts of Branched wax No. 2 instead of Binder resin and Branched wax No. 1 used in Example 1.

EXAMPLE 7

Magnetic toner (7) was prepared and evaluated in the same manner as in Example 1 except for using 19.3 wt. parts of a wax-dispersed binder resin prepared by heat-mixing 80 wt. parts of the polyester resin used in Example 6 and 20 wt. parts of Branched wax No. 4, and 80.7 wt. parts of the polyester resin used in Example 6 instead of Binder resin and Branched wax No. 1 used in Example 1.

EXAMPLES 8 to 14

Magnetic toners (8) to (14) were prepared in the same manner as in Example 1 except for using Branched waxes Nos. 2 to 8, respectively, instead of Branched wax No. 1.

The results of the above-mentioned Examples and Comparative Examples are inclusively shown in the following Table 2.

TABLE 2

| Toner | Fixing test $T_{FIX.min}$ (° C.) | Fixing test $T_{hot.offset}$ (° C.) | Anti-block[1)] 50° C., 10 days | Image density[2)] Initial | Image density[2)] After $2 \times 10^5$ | Wax[3)] dispersion | Rheology Gc/G'p |
|---|---|---|---|---|---|---|---|
| Ex. 1 | 130 | 230 | Rank 4 | 1.38 | 1.38 | Rank 4 | 120 |
| Comp. Ex. | | | | | | | |
| 1 | 130 | 160 | Rank 1 | 0.92 | 0.81 | Rank 1 | 175 |
| 2 | 145 | 240 | Rank 3 | 1.27 | 1.14 | Rank 2 | 45 |
| 3 | 135 | 220 | Rank 3 | 1.18 | 1.02 | Rank 2 | 155 |
| 4 | 145 | 210 | Rank 3 | 1.05 | 0.93 | Rank 2 | 160 |
| 5 | 130 | 190 | Rank 2 | 0.99 | 0.85 | Rank 2 | 165 |
| 6 | 140 | 200 | Rank 3 | 1.26 | 0.97 | Rank 3 | 165 |
| 7 | 140 | 220 | Rank 3 | 1.03 | 1.16 | Rank 2 | 155 |
| 8 | 135 | 190 | Rank 2 | 0.91 | 0.82 | Rank 2 | 165 |
| 9 | 150 | 240 | Rank 3 | 1.24 | 1.08 | Rank 2 | 40 |
| 10 | 145 | 220 | Rank 3 | 1.06 | 1.01 | Rank 2 | 155 |
| Ex. | | | | | | | |
| 2 | 125 | 230 | Rank 5 | 1.37 | 1.40 | Rank 5 | 95 |
| 3 | 130 | 240 | Rank 5 | 1.40 | 1.40 | Rank 5 | 90 |
| 4 | 130 | 240 | Rank 3 | 1.35 | 1.36 | Rank 5 | 140 |
| 5 | 120 | 240 | Rank 4 | 1.38 | 1.40 | Rank 5 | 75 |
| 6 | 120 | 220 | Rank 4 | 1.40 | 1.42 | Rank 4 | 130 |
| 7 | 120 | 230 | Rank 4 | 1.45 | 1.45 | Rank 5 | 120 |
| 8 | 130 | 240 | Rank 5 | 1.42 | 1.40 | Rank 5 | 100 |
| 9 | 120 | 210 | Rank 4 | 1.43 | 1.45 | Rank 5 | 120 |
| 10 | 135 | 250 | Rank 5 | 1.46 | 1.41 | Rank 4 | 70 |
| 11 | 130 | 240 | Rank 5 | 1.39 | 1.38 | Rank 4 | 85 |
| 12 | 135 | 250 | Rank 5 | 1.40 | 1.37 | Rank 4 | 70 |
| 13 | 135 | 250 | Rank 5 | 1.35 | 1.36 | Rank 4 | 70 |
| 14 | 125 | 220 | Rank 4 | 1.34 | 1.31 | Rank 5 | 110 |

EXAMPLE 15

Into a 2 liter-four-necked flask equipped with a high-speed stirrer ("TK-Homomixer", available from Tokushu Kika Kogyo K.K.), 650 wt. parts of deionized water and 500 wt. parts of 1 mol/liter-$Na_3PO_4$ aqueous solution were added, stirred at 12000 rpm and heated to 70° C. To the system, 70 wt. parts of 1.0 mol/liter-$Ca_3Cl_2$ aqueous solution was gradually added to prepare an aqueous dispersion medium containing finely dispersed hardly water-soluble dispersion stabilizer $Ca_3(PO_4)_2$.

| | |
|---|---|
| Styrene | 83 wt. parts |
| n-Butyl acrylate | 17 wt. parts |
| Carbon black ($S_{BET}$ 60 $m^2/g$, oil absorption = 115 ml/g) | 10 wt. parts |
| Polyester resin (Mp (peak molecular weight)) = 5200, Tg = 60° C.) | 4 wt. parts |
| Di-alkylsalicylic acid Al compound (negative charge control agent) | 2 wt. parts |
| Branched wax No. 5 | 15 wt. parts |

The above ingredients were dispersed for 3 hours by an attritor (made by Mitsui Kinzoku K.K.), and 10 wt. parts of 2,2'-azobis(2,4-dimethylvalero-nitrile) was added thereto to form a polymerizable monomer composition.

Then, the polymerizable monomer composition was charged into the above-prepared aqueous dispersion medium, and the system was stirred at 12000 rpm of the high-speed stirrer for 15 min. at an internal temperature of 70° C. to form particles of the monomer composition. Thereafter, the stirrer was replaced by a propeller stirring blade, and the system was stirred at 50 rpm at the same temperature to effect a polymerization for 10 hours.

After the polymerization, the suspension liquid was cooled, and dilute hydrochloric acid was added thereto to remove the dispersion stabilizer. After being washed with water several times, the polymerizate was dried to recover non-magnetic black toner particles (A). The black toner particles (A) showed a weight-average particle size ($D_4$) of 6.5 $\mu$m, a number-basis particle size variation coefficient ($A_{NV}$) of 26%, shape factors SF-1=133, SF-2=124 and a ratio SF-2/SF-1 of 0.93, and exhibited a GPC molecular weight-distribution of THF-soluble content including a peak molecular weight (Mp) of $1.9 \times 10^4$ and Mw/Mn=20. The wax-dispersion state in the black toner particles (A) was observed through a TEM, whereby the wax was dispersed in a substantially spherical state (92) insoluble with the binder resin (91) as shown in FIG. 9A.

100 wt. parts of the black toner particles (A) and hydrophobic silica fine powder ($S_{BET}$=200 $m^2/g$) were blended with each other in a Henschel mixer to obtain Non-magnetic toner No. 1. Then, 6 wt. parts of Non-magnetic toner No. 1 was blended with 94 wt. parts of a resin-coated magnetic ferrite carrier (Dav. =50 $\mu$m) to prepare Developer No. 1 of two-component type for magnetic brush development.

EXAMPLES 16 to 18

Non-magnetic toners Nos. 2 to 4 were prepared and Developers Nos. 2 to 4 of each two-component type were prepared respectively therefrom in the same manner as in Example 15 except for using Branched waxes Nos. 6 to 8, respectively, instead of Branched wax No. 5.

Comparative Example 11

| | |
|---|---|
| Styrene-n-butyl acrylate resin ($Mp = 2.0 \times 10^4$, Mw/Mn = 1.8, Tg = 59° C.) | 100 wt. parts |
| Polyester resin used in Example 15 | 4 wt. parts |
| Carbon black used in Example 15 | 10 wt. parts |
| Negative charge control agent used in Example 15 | 2 wt. parts |
| Comparative wax No. 1 | 15 wt. parts |

The above ingredients were melt-kneaded though a twin-screw extruder, and the melt-kneaded product was, after cooling, coarsely crushed by a hammer mill and then finely pulverized by a jet mill. The resultant fine pulverizate and commercially available fine calcium phosphate fine powder were blended with each other, and the resultant blend was charged into water in a vessel, followed by dispersion by means of a homomixer, gradual heating of the water and holding for heat-treatment at 60° C. for 2 hours, to form non-magnetic black toner particles. Thereafter, dilute hydrochloric acid was added to the vessel to sufficiently dissolve the calcium phosphate fine powder on the toner particle surfaces. The resultant black toner particles were filtered out, dried, sieved through a 200-mesh screen to remove agglomerates, and classified to obtain non-magnetic black toner particles (a). The black toner particles (a) were used instead of the black toner particles (A) otherwise in the same manner as in Example 15 to prepare Comparative non-magnetic toner No. 1 and Comparative developer No. 1 of two-component type respectively.

The wax component in the non-magnetic black toner particles (a) exhibited a fine dispersion state as schematically shown in FIG. 9B.

Comparative Example 12

Non-magnetic black toner particles (b) and Comparative developer No. 2 therefrom were prepared in the same manner as in Comparative Example 11 except for using Comparative wax No. 2 instead of Comparative wax No. 1.

Some properties of Non-magnetic toners Nos. 1 to 4 and Comparative non-magnetic toners Nos. 1 to 2 are inclusively shown in Table 3.

TABLE 3

| | Toner | Wax | Shape factor SF-1 | SF-2 | (SF-2)/(SF-1) | Particle size $D_4$ (μm) | $A_{NV}$ (%) | Wax dispersion state |
|---|---|---|---|---|---|---|---|---|
| Ex. | | | | | | | | |
| 15 | Non-magnetic No. 1 | Branched No. 5 | 133 | 124 | 0.93 | 6.5 | 26 | sphere |
| 16 | Non-magnetic No. 2 | Branched No. 6 | 109 | 106 | 0.96 | 6.0 | 29 | sphere |
| 17 | Non-magnetic No. 3 | Branched No. 7 | 157 | 133 | 0.85 | 7.9 | 32 | spheroidal |
| 18 | Non-magnetic No. 4 | Branched No. 8 | 124 | 112 | 0.90 | 4.2 | 22 | sphere |
| Comp. Ex. 11 | Comparative No. 1 | Comparative No. 1 | 165 | 142 | 0.86 | 10.2 | 32 | fine |
| Comp. Ex. 12 | Comparative No. 2 | Comparative No. 2 | 103 | 115 | 1.12 | 5.7 | 37 | fine |

EXAMPLES 19 to 22 and Comparative Examples 13 and 14

The above-prepared developers were evaluated by using an image forming apparatus as illustrated in FIG. 4. First of all, the outline of the image forming apparatus is explained with reference to FIG. 4.

Referring to FIG. 4, a photosensitive member 101 comprising a support 101*a* and a photosensitive layer 101*b* disposed thereon containing an organic photosemiconductor is rotated in the direction of an arrow and charged so as to have a surface potential of about −600 V by a charging roller 102 (comprising an electroconductive elastic layer 102*a* and a core metal 102*b*). An electrostatic image having a light (exposed) part potential of −100 V and a dark part potential of −600 V is formed on the photosensitive member 101 by exposing the photosensitive member 1 to light-image 103 by using an image exposure means effecting ON and OFF based on digital image information through a polygonal mirror. The electrostatic image is developed with yellow toner particles, magenta toner particles, cyan toner particles or black toner particles contained in plural developing units 104-1 to 104-4 according to the reversal development mode to form color toner images on the photosensitive member 101. Each of the color toner images is transferred to an intermediate transfer member 105 (comprising an elastic layer 105*a* and a core metal 105*b* as a support) to form thereon a superposed four-color image. Residual toner particles on the photosensitive member 101 after the transfer are recovered by a cleaning member 108 to be contained in a residual toner container 109.

The intermediate transfer member 105 is formed by applying a coating liquid for the elastic layer 105*a* comprising carbon black (as an electroconductivity-imparting material) sufficiently dispersed in acrylonitrile-butadiene rubber (NBR) onto a pipe-like core metal 105*b*. The elastic layer 105*a* of the intermediate transfer member 105 shows a hardness of 30 degrees as measured by JIS K−6301 and a volume resistivity (Rv) of $10^9$ ohm.cm. The transfer from the photosensitive member 1 to the intermediate transfer member 5 is performed by applying a voltage of +500 V from a power supply to the core metal 105*b* to provide a necessary transfer current of about 5 μA.

The transfer roller 107 has a diameter of 20 mm and is formed by applying a coating liquid for the elastic layer 107*a* comprising carbon (as an electroconductivity-imparting material) sufficiently dispersed in a foamed ethylene-propylene-diene terpolymer (EPDM) onto a 10 mm dia.-core metal 107*b*. The elastic layer 107*a* of the transfer roller 107 shows a hardness of 35 degrees as measured by JIS K- 6301 and a volume resistivity of $10^6$ ohm.cm. The transfer from the intermediate transfer member 105 to a transfer-receiving material 106 is performed by applying a voltage to the transfer roller 107 to provide a transfer current of 15 μA.

The heat-fixing device H is a hot roller-type fixing device having no oil applicator system. The upper roller and lower roller are both surfaced with a fluorine-containing resin and have a diameter of 60 mm. The fixing temperature is 160° C. and the nip width is set to 7 mm.

Under the above-set conditions, each of the above-prepared Developers Nos. 1 to 4 and Comparative developers Nos. 1 to 2 each of two-component type was subjected to a black single color mode continuous printing test (i.e., by a toner consumption promotion mode without pose of the developing device) at a print-out speed of 12 A-4 size sheets/min. in an environment of normal temperature/normal humidity (N.T./N.H.=25° C./60% RH), low temperature/low humidity (L.T./L.H.=15° C./10% RH) or high temperature/high humidity (H.T./H.H.=30° C./85% RH), whereby the printed-out image quality was evaluated.

Each developer was also evaluated with respect to matching with the image forming apparatus used.

Residual toner recovered by cleaning was conveyed to and re-used in the developing device by means of a re-use mechanism.

The evaluation results are inclusively shown in Tables 4 and 5.

TABLE 4

| | Print-out image evaluation results | | | | | | | | | |
|---|---|---|---|---|---|---|---|---|---|---|
| | 25° C./60% RH | | | | 30° C./80% RH | | | | | |
| | I.D. | Dot | Fog | Hollow image | I.D. | Dot | Fog | Hollow image | Fixa-bility | Anti-offset |
| Ex. | | | | | | | | | | |
| 19 | A | A | A | A | A | A | A | A | A | A |
| 20 | A | A | A | A | A | B | B | A | B | A |
| 21 | A | B | B | B | B | C | B | C | C | B |
| 22 | B | A | B | A | C | C | B | B | A | B |
| Comp. Ex. | | | | | | | | | | |
| 13 | C | D | C | D | D | D | C | D | D | D |
| 14 | C | C | D | C | C | D | D | D | D | C |

TABLE 5

| | Matching with image forming apparatus | | |
|---|---|---|---|
| | Photosensitive drum | Intermediate transfer member | Fixing device |
| Ex. 19 | A | A | A |
| Ex. 20 | B | A | B |
| Ex. 21 | B | C | C |
| Ex. 22 | C | C | B |
| Comp. Ex. 13 | D | D | D |
| Comp. Ex. 14 | D | D | D |

EXAMPLE 23 and Comparative Example 15

The developing device of the image forming apparatus shown in FIG. 4 and used in Example 19, etc. was replaced by one illustrated in FIG. 5, and each of Non-magnetic toner No. 1 and Comparative non-magnetic toner No. 1 was subjected to an image forming test according to an intermittent mode wherein a pause of 10 sec. was inserted between successive image formation cycles so as to promote the deterioration of the toner due to a preliminary operation accompanying re-start-up of the developing device, while setting the peripheral moving speed of the toner carrying member to 3.0 times that of the electrostatic image-bearing member and successively replenishing the toner as required. The evaluation was performed similarly as in Example 19, etc.

The toner-carrying member used had a surface roughness Ra of 1.5, the toner regulating blade was one obtained applying a urethane rubber sheet onto a phosphor bronze base sheet and further coating it with nylon to provide an abutting surface. The fixing device H was replaced by one illustrated in FIGS. 7 and 8 including a heating member for heating the toner image via a heat resistant film. The heating member 131 was set to have a surface temperature of 140° C. as measured by a temperature-detecting element 131*d*, and the heating member 131 was abutted against the sponge pressure roller 133 at a total pressure of 8 kg so as to provide a nip of 6 mm between the sponge pressure roller 133 and the fixing film 32. The fixing film 132 comprised a 60 μm-thick-heat-resistant polyimide film coated with a low-resistivity release layer comprising polytetrafluoroethylene (of high molecular weight-type) with an electroconductive substance therein on its surface contacting a transfer paper.

The results of evaluation are shown in Table 6.

TABLE 6

| | Print-out image evaluation and matching with apparatus | | | | | | | | | | |
|---|---|---|---|---|---|---|---|---|---|---|---|
| | Print-out image | | | | | | | | | | |
| | 25° C./60% RH | | | | 30° C./80% RH | | | | Image | Matching with | |
| | I.D. | Dot | Fog | Ghost | I.D. | Dot | Fog | Ghost | gloss | Sleeve | Transfer member |
| Ex. 23 | A | A | A | A | A | A | A | A | Good | A | A |
| Comp. Ex. 15 | C | D | C | C | D | D | C | D | un-uniform gloss | D | D |

Explanation of evaluation items shown in the above Tables will be supplemented hereinbelow.

[Print-Out Image Evaluation]

<1>I.D. (Image Density)

Evaluated based on a relative image density after printing out on a prescribed number of ordinary copying paper (75 g/m$^2$) by a Macbeth reflective densitometer relative to a print-out image of a white grouped portion having an original density of 0.00 according to the following standard:

A: Very good (≧1.40)

B: Good (≧1.35 and <1.40)

C: Fair (≧1.00 and <1.35)

D: Poor (<1.00)

<2>Dot (Dot Reproducibility)

Figure 10:
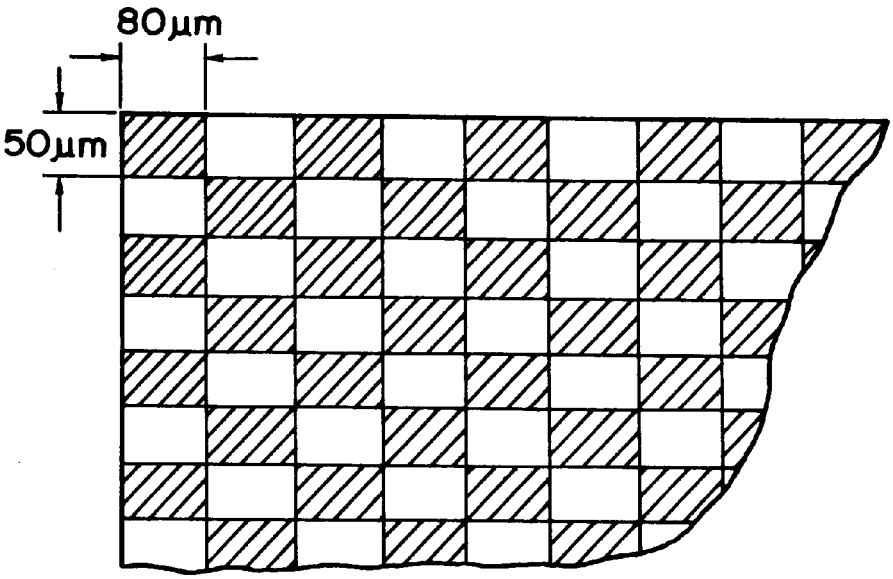
FIG. 10 is a partial illustration of a checker pattern for evaluating the developing performance of a toner.

A checker pattern image as shown in FIG. 10 which is generally difficult to reproduce because the electric field is liable to be closed due to a latent image electric field was reproduced as a printed image, and the reproducibility of dots (checker units) was evaluated.

A: Very good (lack of at most 2 dots/100 dots)

B: Good (lack of 3–5 dots/100 dots)

C: Fair (lack of 6–10 dots/100 dots)

D: Poor (lack of 11 or more dots/100 dots)

<3>Fog

Image fog was evaluated based on a fog density (%) based on a difference in whiteness (reflectance) between a white ground portion of a printed-out image and transfer paper per se before printing based on values measured by using a reflective densitometer ("REFLECTOMETER" available from Tokyo Denshoku K.K.)

A: Very good (<1.5%)

B: Good (≧1.5% and <2.5%)

C: Fair (≧2.5% and <4.0%)

D: Poor (≧4%)

<4>Hollow Image

Figure 11A:
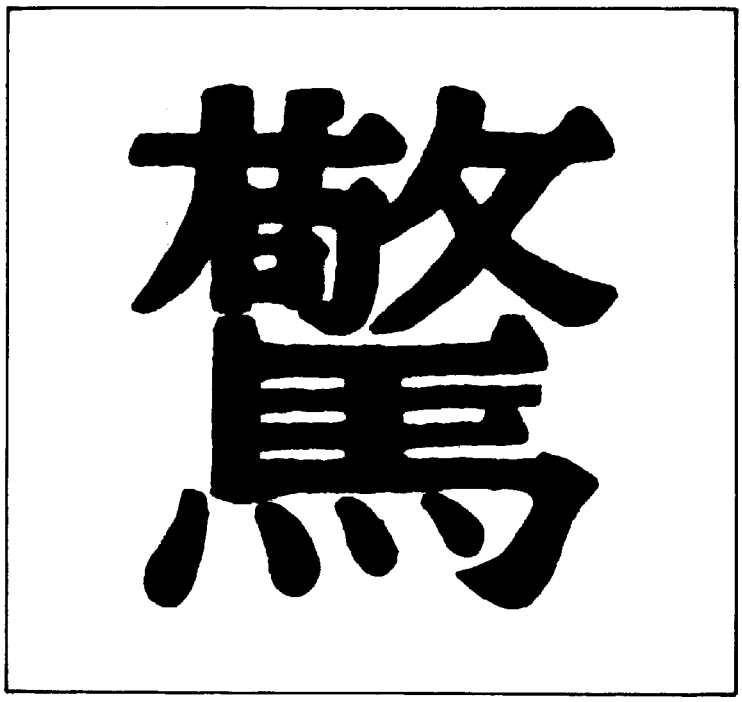
FIGS. 11A and 11B are illustrations of reproduced characters in a normal state and a state accompanied with a hollow image dropout.
Figure 11B:
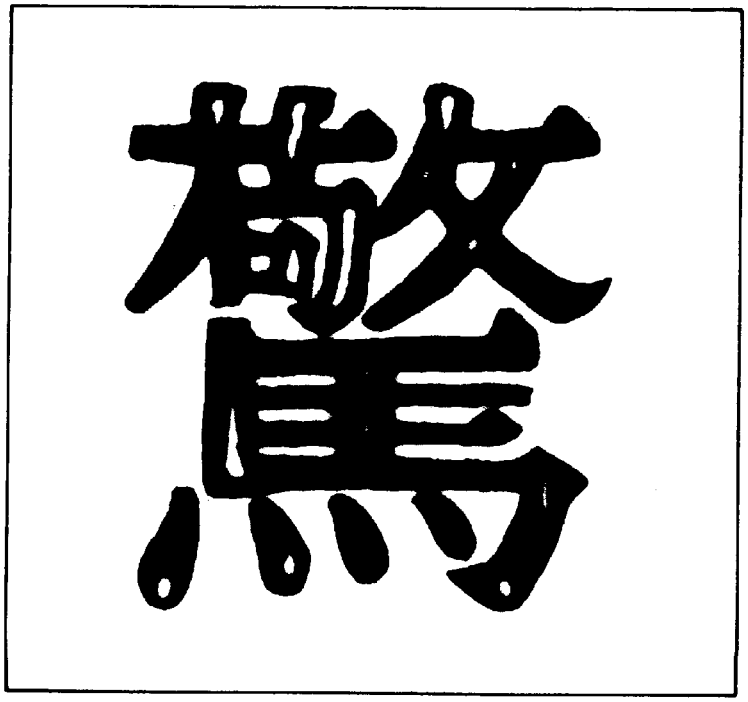

A 12 point-size character pattern as shown in FIG. 11A was printed on a thick paper (128 g/m$^2$) to observe the occurrence of hollow image (dropout of a middle portion) with eyes.

A: Very good (almost no)

B: Good (very slight)

C: Fair

D: Poor (remarkable)

<5>Ghost (Sleeve Ghost)

Figures 12A, 12B, 12C:
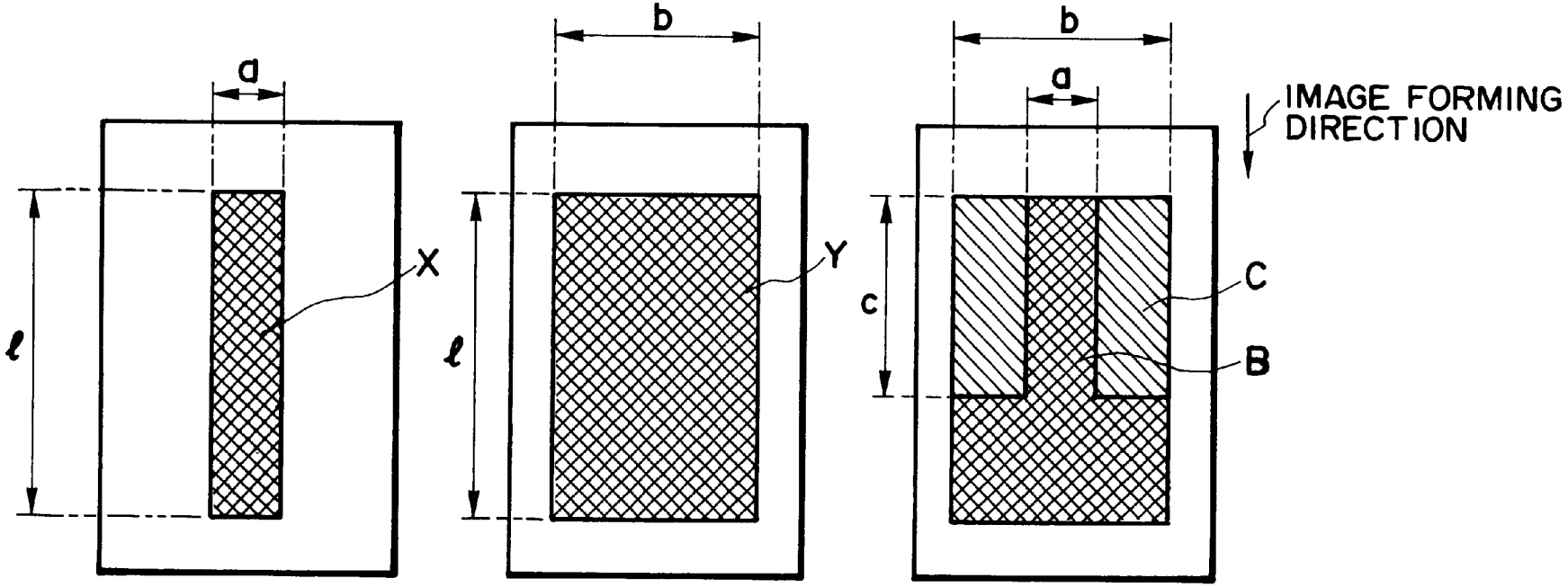
FIGS. 12A–12C illustrate a sleeve ghost.

A solid-black stripe-shaped image X having a width a and a length 1 s shown in FIG. 12A was printed out, and then a halftone image Y having a width b (>a) and a length 1' as shown in FIG. 12B was printed immediately thereafter to observe the presence or absence of density difference among portions A, B and C in the halftone image Y as illustrated in FIG. 12C with eyes.

A: Very good (no difference observed at all)

B: Good (slight density difference observed between portions B and C)

C: Fair (some density difference observed between any two of A, B and C)

D: Poor (remarkable density difference)

<6>Fixability

A fixed toner image was rubbed with a soft tissue paper (lens-cleaning paper) under a load of 50 g/cm$^2$ to measure a decrease (%) in image density for evaluation of the fixability.

A: Very good (<5%)

B: Good (≧5% and <10%)

C: Fair (≧10% and <20%)

D: Poor (≧20%)

<7>Anti-Offset Characteristic

A sample image having an image areal percentage of ca. 5% was continually printed, and the degree of soiling on a print-out sheet was evaluated after printing on 3000 sheets.

[Evaluation of Matching the Image Forming Apparatus]

<1>Matching with a Developing Sleeve

After the print-out test, the state of occurrence of residual toner sticking onto the developing sleeve surface and the influence thereof on the printed-out images were evaluated with eyes.

A: Very good (not observed)

B: Good (almost not observed)

C: Fair (sticking observed but little influence on the images)

D: Poor (much sticking and resulted in image irregularity)

<2>Matching with a Photosensitive Drum

After the print-out test, the damages on the photosensitive drum surface, the state of occurrence of residual toner sticking onto the drum surface and the influences thereof on the printed-out images were evaluated with eyes.

A: Very good (not observed)

B: Good (slight damage observed but no influence on the images)

C: Fair (sticking and damage observed but little influence on the images)

D: Poor (much sticking and resulted in vertical streak image defects)

<3>Matching with an Intermediate Transfer Member

After the print-out test, the state of damages and residual toner sticking on the surface of the intermediate transfer member, and the influence thereof on the printed-out images, were evaluated with eyes.

A: Very good (not observed)

B: Good (surface residual toner observed but no influence on the images)

C: Fair (sticking and damage observed but little influence on the images)

D: Poor (much sticking and resulted in image irregularity)

<4>Matching with a Fixing Device

After the print-out test, the state of damage and residual toner sticking on the fixing film, and the influence thereof on the printed-out images, were evaluated with eyes.

A: Very good (not observed)

B: Good (slight slicking observed but no influence on the images)

C: Fair (sticking and damage observed but little influence on the images)

D: Poor (much sticking and resulted in image defects)

EXAMPLE 24

Non-magnetic cyan toner particles, yellow toner particles and magenta toner particles were respectively prepared in the same manner as in Example 15 except for using 7 wt. parts each of a cyan colorant (C.I. Pigment Blue 15:3), a yellow colorant (C.I. Pigment Yellow) and a magenta colorant (C.I. Pigment Red 202), respectively, instead of the carbon black. From these non-magnetic color toner particles, a cyan developer, a yellow developer and a magenta developer respectively of two-component type for magnetic brush development were respectively prepared in the same manner as in Example 15.

By charging the above-prepared cyan developer, magenta developer and yellow developer into the developing devices 104-1, 104-2 and 104-3, respectively, shown in FIG. 4 and further charging the black developer of two-component type used in Example 15 into the developing device 104-4, a full-color mode image forming test including the development, transfer and fixation was performed by using the image forming apparatus shown in FIG. 4, whereby the respective toners showed good fixability and anti-high-temperature offset characteristic to provide high-quality full-color images.

What is claimed is:

1. A toner for developing an electrostatic image, comprising: toner particles each containing at least a binder resin, a colorant, and a wax having a branched structure and a methyl group at terminals of chains of the wax;

wherein the wax satisfies conditions of:

(a) showing a maximum heat-absorption peak in a region of 50–130° C. on temperature increase on a DSC (differential scanning calorimeter) curve, and (b) giving a $^{13}$C-NMR (nuclear magnetic resonance) spectrum showing a total peak area S in a range of 0–50 ppm, a total peak area S1 in a range of 36–42 ppm and a total peak area S2 in a range of 10–17 ppm satisfying:

$$1.0 \leqq (S1/S) \times 100 \leqq 10,\ 1.5 \leqq (S2/S) \times 100 \leqq 15, \text{ and } S1 < S2.$$

2. The toner according to claim 1, wherein the wax provides a $^{13}$C-NMR spectrum showing a plurality of peaks in the range of 10–17 ppm.

3. The toner according to claim 1, wherein the toner particles provides a sectional view as observed through a transmission electron microscope (TEM) showing wax particles dispersed in a substantially spherical and/or spheroidal island shape in a state insoluble with the binder resin.

4. The toner according to claim 1, wherein the toner particles have a shape factor SF-1 of 100–160 and a shape factor SF-2 of 100–140 giving a ratio (SF-2)/(SF-1) of at most 1.0.

5. The toner according to claim 1, wherein the wax exhibits a metal viscosity $\eta_1$ at a temperature 5° C. higher than the maximum heat-absorption peak temperature and a melt viscosity $\eta_2$ at a temperature 15° C. higher than the maximum heat-absorption peak temperature providing a ratio $\eta_1/\eta_2$ of at most 10.

6. The toner according to claim 5, wherein the wax exhibits a ratio $\eta_1/\eta_2$ of 0.1–7.

7. The toner according to claim 5, wherein the wax exhibits a ratio $\eta_1/\eta_2$ of 0.2–5.

8. The toner according to claim 1, wherein the wax provides a DSC curve exhibiting a maximum heat-absorption peak in a temperature range of 60–120° C. on temperature increase.

9. The toner according to claim 1, wherein the wax provides a DSC curve exhibiting a maximum heat-absorption peak in a temperature range of 65–100° C. on temperature increase.

10. The toner according to claim 1, wherein the wax provides a ratio $S_1/S$ of 1.5–8.0.

11. The toner according to claim 1, wherein the wax provides a ratio $S_1/S$ of 2.0–6.0.

12. The toner according to claim 1, wherein the wax provides a ratio $S_2/S$ of 2.0–13.0.

13. The toner according to claim 1, wherein the wax provides a ratio $S_2/S$ of 3.0–10.0.

14. The toner according to claim 1, wherein the toner exhibits viscoelasticity characteristics such that it has a first temperature between 50–70° C. where the storage modulus (G') and the loss modulus (G") are identical to each other, has a second temperature between 65–80° C. where a ratio G'/G" assumes a maximum, and provides a ratio (Gc/G'p) of a storage modulus Gc at the first temperature to a loss modulus G'p at the second temperature of at least 50.

15. The toner according to claim 14, wherein the toner provides a ratio Gc/G'p of 55–150.

16. The toner according to claim 14, wherein the toner provides a ratio Gc/G'p of 60–120.

17. The toner according to claim 1, wherein the wax has a weight-average molecular weight (Mw) of 600–50,000.

18. The toner according to claim 17, wherein the wax has an Mw of 800–40,000.

19. The toner according to claim 17, wherein the wax has an Mw of 1,000–30,000.

20. The toner according to claim 1, wherein the wax has a number-average molecular weight (Mn) of 400–4,000.

21. The toner according to claim 20, wherein the wax has an Mn of 450–3,500.

22. The toner according to claim 1, wherein the wax has an Mw/Mn ratio of 3.5–30.

23. The toner according to claim 1, wherein the wax has an Mw/Mn ratio of 4–25.

24. The toner according to claim 1, wherein the wax has a branched chain structure represented by the following formula:

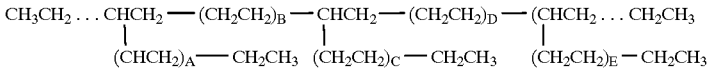

wherein A, C and E respectively denote a positive number of at least 1, and B and D denote a positive number.

25. The toner according to claim 1, wherein the wax comprises a copolymer of ethylene and an α-monoolefinic hydrocarbon as represented by

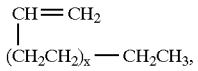

wherein x is an integer of at least 1.

26. The toner according to claim 25, wherein the wax comprises a copolymer of ethylene and an α-mono-olefinic hydrocarbon having an average of x of 5–30.

27. An image forming method, comprising:

a charging step of charging an electrostatic image-bearing member, a latent image forming step of forming an electrostatic image on the electrostatic image-bearing member, a developing step of developing the electrostatic image with the above-mentioned toner to form a toner image on the electrostatic image-bearing member, a transfer step of transferring the toner image on the electrostatic image-bearing member onto a transfer receiving material via or without via an intermediate transfer member, and a fixing step of fixing the toner image onto the transfer-receiving material under application of heat;

wherein the toner comprises toner particles each containing at least a binder resin, a colorant, and a wax having a branched structure and a methyl group at terminals of the chains of the wax; and the wax satisfied conditions of:

(a) showing a maximum heat-absorption peak in a region of 50–130° C. on temperature increase on a DSC (differential scanning calorimeter) curve, and (b) giving a $^{13}$C-NMR (nuclear magnetic resonance) spectrum showing a total peak area S in a range of 0–50 ppm, a total peak area S1 in a range of 36–42 ppm and a total peak area S2 in a range of 10–17 ppm satisfying:

$$1.0 \leqq (S1/S) \times 100 \leqq 10,\ 1.5 \leqq (S2/S) \times 100 \leqq 15, \text{ and } S1 < S2.$$

28. The method according to claim 27, wherein the toner image on the electrostatic image-bearing member is transferred onto the transfer-receiving material via an intermediate transfer member.

29. The method according to claim 27, wherein, in the developing step, the electrostatic image is developed with the toner carried on a toner-carrying member which moves at a superficial velocity that is 1.05–3.0 times that of the electrostatic image-bearing member at the developing position, and the toner-carrying member has a surface roughness Ra of at most 1.5 $\mu$m.

30. The method according to claim 27, wherein, in the developing step, the electrostatic image is developed with the toner carried on a toner-carrying member which is equipped with a ferromagnetic metal blade disposed opposite to and with a small gap from the toner carrying member.

31. The method according to claim 27, wherein, in the developing step, the electrostatic image is developed with the toner carried on a toner-carrying member which is equipped with an elastic blade abutted against the toner-carrying member.

32. The method according to claim 27, wherein, in the developing step, the electrostatic image is developed with the toner carried on a toner-carrying member disposed with a prescribed gap from the electrostatic image-bearing member under application of an alternating electric field between the toner-carrying member and the electrostatic image-bearing member.

33. The method according to claim 27, wherein, in the charging step, the electrostatic image-bearing member is charged by causing a charging member to contact the electrostatic image-bearing member and applying a voltage to the charging member from an external voltage supply.

34. The method according to claim 27, wherein, in the transfer step, the transfer-receiving material is pressed against the electrostatic image-bearing member by a transfer member for electrostatically transferring the toner image onto the transfer-receiving material.

35. The method according to claim 27, wherein, in the fixing step, the toner image is fixed onto the transfer-receiving material by a heat-fixing device free from an offset-preventing liquid supply mechanism or a fixing device cleaner.

36. The method according to claim 35, wherein the heat-fixing device comprises a fixedly supported heating member, a fixing film covering the heating member and a pressing member disposed opposite to the heating member so as to press the transfer-receiving material against the heating member via the fixing film.

37. The method according to claim 27, wherein the steps are performed in an image forming apparatus including a toner re-use mechanism for cleaning and recovering a transfer-residual toner remaining on the electrostatic image-bearing member after the transfer step and supplying the recovered toner to developing means.

38. The method according to claim 27, wherein the wax provides a $^{13}$C-NMR spectrum showing a plurality of peaks in the range of 10–17 ppm.

39. The method according to claim 27, wherein the toner particles provides a sectional view as observed through a transmission electron microscope (TEM) showing wax particles dispersed in a substantially spherical and/or spheroidal island shape in a state insoluble with the binder resin.

40. The method according to claim 27, wherein the toner particles have a shape factor SF-1 of 100–160 and a shape factor SF-2 of 100–140 giving a ratio (SF-2)/(SF-1) of at most 1.0.

41. The method according to claim 27, wherein the wax exhibits a metal viscosity $\eta_1$ at a temperature 5° C. higher than the maximum heat-absorption peak temperature and a melt viscosity $\eta_2$ at a temperature 15° C. higher than the maximum heat-absorption peak temperature providing a ratio $\eta_1/\eta_2$ of at most 10.

42. The method according to claim 41, wherein the wax exhibits a ratio $\eta_1/\eta_2$ of 0.1–7.

43. The method according to claim 41, wherein the wax exhibits a ratio $\eta_1/\eta_2$ of 0.2–5.

44. The method according to claim 27, wherein the wax provides a DSC curve exhibiting a maximum heat-absorption peak in a temperature range of 60–120° C. on temperature increase.

45. The method according to claim 27, wherein the wax provides a DSC curve exhibiting a maximum heat-absorption peak in a temperature range of 65–100° C. on temperature increase.

46. The method according to claim 27, wherein the wax provides a ratio $S_1/S$ of 1.5–8.0.

47. The method according to claim 2, wherein the wax provides a ratio $S_1/S$ of 2.0–6.0.

48. The method according to claim 27, wherein the wax provides a ratio $S_2/S$ of 2.0–13.0.

49. The method according to claim 27, wherein the wax provides a ratio $S_2/S$ of 3.0–10.0.

50. The method according to claim 27, wherein the toner exhibits viscoelasticity characteristics such that it has a first temperature between 50–70° C. where the storage modulus (G') and the loss modulus (G") are identical to each other, has a second temperature between 65–80° C. where a ratio G'/G" assumes a maximum, and provides a ratio (Gc/G'p) of a storage modulus Gc at the first temperature to a loss modulus G'p at the second temperature of at least 50.

51. The method according to claim 50, wherein the toner provides a ratio Gc/G'p of 55–150.

52. The method according to claim 50, wherein the toner provides a ratio Gc/G'p of 60–120.

53. The method according to claim 27, wherein the wax has a weight-average molecular weight (Mw) of 600–50,000.

54. The method according to claim 53, wherein the wax has an Mw of 800–40,000.

55. The method according to claim 53, wherein the wax has an Mw of 1,000–30,000.

56. The method according to claim 27, wherein the wax has a number-average molecular weight (Mn) of 400–4,000.

57. The method according to claim 56, wherein the wax has an Mn of 450–3,500.

58. The method according to claim 27, wherein the wax has an Mw/Mn ratio of 3.5–30.

59. The method according to claim 27, wherein the wax has an Mw/Mn ratio of 4–25.

60. The method according to claim 27, wherein the wax has a branched chain structure represented by the following formula:

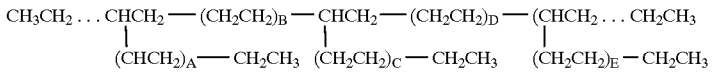

61. The method according to claim 27, wherein the wax comprises a copolymer of ethylene and an α-mono-olefinic hydrocarbon as represented by

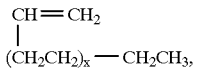

wherein x is an integer of at least 1.

62. The method according to claim 61, wherein the wax comprises a copolymer of ethylene and an α-mono-olefinic hydrocarbon having an average of x of 5–30.

* * * * *

UNITED STATES PATENT AND TRADEMARK OFFICE

CERTIFICATE OF CORRECTION

PATENT NO. : 6,040,103

DATED : March 21, 2000

INVENTOR(S) : MANABU OHNO ET AL.

It is certified that error appears in the above-identified patent and that said Letters Patent is hereby corrected as shown below:

Title page,

[56] REFERENCES CITED

Insert: --0-587901 3/1994 European Pat. Off.--.

"0-587901 3/1994 Japan." should be deleted.

"61-273554 12/1985 Japan" should read --61-273554 12/1986 Japan--.

COLUMN 5

Line 40, "specifically." should read --specifically,--.

COLUMN 6

Line 11, "invention" should read --invention.--.

COLUMN 7

Line 3, "o" should read --to--.

UNITED STATES PATENT AND TRADEMARK OFFICE

CERTIFICATE OF CORRECTION

PATENT NO. : 6,040,103

DATED : March 21, 2000

INVENTOR(S) : MANABU OHNO ET AL.

It is certified that error appears in the above-identified patent and that said Letters Patent is hereby corrected as shown below:

COLUMN 7

Line 33, "another" should read --other--

COLUMN 10

Line 8, "anhydride." should read --anhydrides--

COLUMN 11

Line 28, "$1.0x10^5 1.0x$" should read --$1.0x10^5$-1.0x--

COLUMN 12

Line 11, "($PbFe_{12}O_a$)," should read --($PbFe_{12}O_{19}$),--

Line 13, "($BaFe_{12}Oa$)," should read --($BaFe_{12}O_{19}$),--

Line 26, "(as)" should read --(σs)--

Line 27, "(or)" should read --(σr)--

Line 51, "chromium" should read --Chromium--

UNITED STATES PATENT AND TRADEMARK OFFICE

CERTIFICATE OF CORRECTION

PATENT NO. : 6,040,103

DATED : March 21, 2000

INVENTOR(S) : MANABU OHNO ET AL.

It is certified that error appears in the above-identified patent and that said Letters Patent is hereby corrected as shown below:

COLUMN 15

Line 4, "develope" should read --develop--

Line 7, "faithful to by" should read --faithfully by--

COLUMN 17

Line 16, "operates" should read --operate--

COLUMN 21

Line 34, "hear" should read --shear--

COLUMN 41

Line 50, "s" should read --as--

COLUMN 43

Line 33, "provides" should read --provide--

UNITED STATES PATENT AND TRADEMARK OFFICE

CERTIFICATE OF CORRECTION

PATENT NO. : 6,040,103

DATED : March 21, 2000

INVENTOR(S) : MANABU OHNO ET AL.

It is certified that error appears in the above-identified patent and that said Letters Patent is hereby corrected as shown below:

COLUMN 44

Line 60, "α-mono-olefinic" should read --α-monoolefinic--

COLUMN 46

Line 24, "provides" should read --provide--

COLUMN 47

Line 8, "600-50," should read --600-50,- --

Line 23, "α-mono-olefinic" should read --α-monoolefinic--

COLUMN 48

Line 25, "α-mono-olefinic" should read --α-monoolefinic--

Signed and Sealed this

Tenth Day of April, 2001

Nicholas P. Godici

*Attest:*

NICHOLAS P. GODICI

*Attesting Officer*

*Acting Director of the United States Patent and Trademark Office*